US012270284B1

(12) United States Patent
Nemez et al.

(10) Patent No.: US 12,270,284 B1
(45) Date of Patent: Apr. 8, 2025

(54) PERFORATING GUN HAVING GROUNDING ASSEMBLY

(71) Applicant: SWM International, LLC, Pampa, TX (US)

(72) Inventors: Keith Nemez, Pampa, TX (US); Terrell C. Saltarelli, Weatherford, TX (US); David C. Parks, Calgary (CA)

(73) Assignee: SWM International, LLC, Pampa, TX (US)

( * ) Notice: Subject to any disclaimer, the term of this patent is extended or adjusted under 35 U.S.C. 154(b) by 0 days.

(21) Appl. No.: 18/431,084

(22) Filed: Feb. 2, 2024

(51) Int. Cl.
*E21B 43/1185* (2006.01)
*E21B 43/117* (2006.01)

(52) U.S. Cl.
CPC ..... *E21B 43/1185* (2013.01); *E21B 43/117* (2013.01)

(58) Field of Classification Search
CPC .... E21B 43/117; E21B 43/119; E21B 43/116; E21B 43/1185
See application file for complete search history.

(56) References Cited

U.S. PATENT DOCUMENTS

| | | | | |
|---|---|---|---|---|
| 4,598,775 | A | 7/1986 | Vann et al. | |
| 8,943,943 | B2 | 2/2015 | Tassaroli | |
| 10,422,195 | B2 | 9/2019 | Lagrange et al. | |
| 11,697,980 | B2 | 7/2023 | Goyeneche | |
| 11,867,032 | B1 * | 1/2024 | Parks | E21B 43/1185 |
| 2013/0118342 | A1 * | 5/2013 | Tassaroli | E21B 43/119 89/1.15 |
| 2013/0220614 | A1 | 8/2013 | Torres et al. | |
| 2015/0337635 | A1 | 11/2015 | Langford et al. | |
| 2016/0356132 | A1 | 12/2016 | Burmeister et al. | |
| 2017/0052011 | A1 | 7/2017 | Parks et al. | |
| 2018/0202789 | A1 | 7/2018 | Parks et al. | |
| 2019/0085664 | A1 | 3/2019 | Hardesty et al. | |
| 2019/0330961 | A1 | 10/2019 | Knight et al. | |
| 2020/0199983 | A1 * | 6/2020 | Preiss | E21B 43/119 |
| 2021/0189846 | A1 * | 6/2021 | Bradley | E21B 43/117 |
| 2022/0178230 | A1 | 6/2022 | Eitschberger et al. | |
| 2022/0258103 | A1 | 8/2022 | Eitschberger et al. | |

(Continued)

FOREIGN PATENT DOCUMENTS

WO WO-2022184731 A1 * 9/2022

OTHER PUBLICATIONS

Owen Oil Tools, "2.500" GoGun(R) Adaptive Perforating System, Technical Manual, copyright 2020-2023, dated Feb. 28, 2023.

(Continued)

*Primary Examiner* — Daniel P Stephenson
(74) *Attorney, Agent, or Firm* — Cabello Hall Zinda PLLC

(57) ABSTRACT

A perforating gun includes a charge holder that is positioned in a carrier. End fittings are affixed to the ends of the holder and support the holder in a longitudinal passage of the carrier. Both end fittings have electrical conductors for an electrical signal disposed therethrough. The first end fitting also has a ground conductor for a ground signal. At least one elastic conductor is attached to the holder and is engaged laterally in a direction relative to the longitudinal passage. The at least one elastic conductor is disposed in electrical communication with the carrier and the ground signal to improve the grounding of the charge assembly and its components in the gun's carrier.

25 Claims, 16 Drawing Sheets

(56) References Cited

U.S. PATENT DOCUMENTS

| | | | |
|---|---|---|---|
| 2023/0069950 | A1 | 3/2023 | Badii et al. |
| 2023/0029249 | A1 | 5/2023 | Garg et al. |
| 2023/0193727 | A1 | 6/2023 | Eitschberger et al. |
| 2023/0203923 | A1 | 8/2023 | Eitschberger |

OTHER PUBLICATIONS

Yellow Jacket Oil Tools, "PC4(TM) Perforating Guns," Brochure, dated Sept. 1, 2022.
Yellow Jacket Oil Tools, "Preloaded Complete Perforating Gun System (PC3)," Brochure, dated Jan. 24, 2023.
Yellow Jacket Oil Tools, "Pull & Play(TM) Perforating Gun System (DH2)," Brochure, dated Nov. 29, 2023.

* cited by examiner

PERFORATING GUN HAVING GROUNDING ASSEMBLY

FIELD OF THE DISCLOSURE

The present disclosure relates generally to downhole perforating gun systems, and more particularly to manufacture, assembly, and methods of operation for a perforating gun and associated system.

BACKGROUND OF THE DISCLOSURE

In a conventional oil and gas well, the wellbore is cased and cemented to isolate the wellbore from the surrounding formation, which has the reservoir fluids of interest. To begin production, the casing and cement are perforated at desired depths to provide a flow path for the oil and gas. After perforating, hydraulic stimulation and fracturing operations can be performed.

A perforating gun is a device used to perforate the casing and the cement in the wellbore. The perforating gun has explosive shaped charges that produce the perforations in the casing and cement when detonated. A conventional perforating gun includes an outer gun carrier having the explosive charges, which can shoot radially outward when detonated. Typically, multiple perforating guns are connected together to form a perforating gun string, which is conveyed downhole in the casing using a wireline or a tubing string.

When making the perforations, the shaped charges are detonated at selected depths in the wellbore. In addition to selected depths, the shaped charges can preferably be detonated in desired directions (e.g., at an angle relative to horizontal) to produce the perforations in the casing. For example, the perforations can preferably be oriented in a direction of maximum principal stress or a preferred fracture plane (PFP) of the formation so hydraulic fracturing operations can be more successful.

Electrical signals are telemetered downhole to the perforating guns to activate and fire the shaped charges. Addressable switches on the perforating guns can be used to control the activation and firing of particular guns at particular times and depths during operations. As expected, the pathways in the perforating guns used for communication of the electrical signals needs to be reliable and robust. Additionally, pathways for grounding the components of the perforating guns also needs to be reliable and robust. Operators are continually trying to improve the electrical communication and grounding pathways used in perforating guns while also attempting to simplify the assembly and operation of the perforating guns.

The subject matter of the present disclosure is directed to overcoming, or at least reducing the effects of, one or more of the problems set forth above.

SUMMARY OF THE DISCLOSURE

Some implementations disclosed herein relate to a perforating gun. In one configuration, for example, the perforating gun includes a carrier and a holder. The carrier defines a longitudinal passage therethrough. The holder has one or more charge receptacles, and the holder has a longitudinal axis and is configured to position in the longitudinal passage. The perforating gun further include a first electrical conductor configured to conduct an electrical signal for the perforating gun and includes a ground conductor configured to conduct a ground signal for the perforating gun. At least one elastic conductor extends between the holder and the longitudinal passage and is elastic at least in a rotational direction about the longitudinal axis of the holder. The at least one elastic conductor is disposed in electrical communication with the carrier and the ground signal.

The described implementations can also include one or more of the following features. The at least one elastic conductor can be selected from the group of a spring, an extension spring, a compression spring, a coil spring, a bow spring, a leaf spring, a serpentine spring, a brush, a bristle, and a wire. For example, the at least one elastic conductor can include first and second element ends and can include an intermediate length between the first and second element ends. The first and second element ends can be attached respectively at first and second points to the holder, and the intermediate length can extend in a direction away from the holder toward the longitudinal passage. Alternatively, the first and second element ends can be attached respectively at first and second points to the longitudinal passage, and the intermediate length can extend in the direction away from the longitudinal passage toward the holder.

The intermediate length of the at least one elastic conductor can be disposed parallel to the longitudinal axis of the holder, disposed along the longitudinal axis of the holder, disposed perpendicular to the longitudinal axis of the holder, disposed laterally relative to the longitudinal axis of the holder, disposed diagonally across the longitudinal axis of the holder, or disposed non-longitudinal relative to the longitudinal axis of the holder.

The at least one elastic conductor can include a coil spring having first and second spring ends between an intermediate portion. The first and second spring ends can be configured to attach to respective points on the holder, and the intermediate portion can be biased in a direction away from the holder toward the longitudinal passage. At least one of the first and second spring ends of the coil spring can be affixed with a fastener to the holder.

The at least one elastic conductor can include a fixture and a coil spring. The fixture can have first and second fixture ends, which are configured to attach to respective points on the holder. The coil spring can have first and second spring ends between an intermediate portion. The first and second spring ends can be attached respectively toward the first and second fixture ends. The intermediate portion can be biased in a direction away from the holder toward the longitudinal passage. In one example, the fixture can include a bow spring, and at least one of the first and second fixture ends of the bow spring can be affixed with a fastener to the holder and/or with a clip engaged against an edge defined in the holder.

The holder can be comprised of a conductive material configured to conduct the ground signal, and the ground signal can be conducted by a wire, a wireless contact, or a wireless trace between the ground conductor and the holder. Alternatively, the holder can be comprised of a non-conductive material, and the ground signal can be conducted by a wire, a wire contact, or a wireless trace between the ground conductor and the at least one elastic conductor.

The holder can include a first end configured to support the holder in the longitudinal passage. The first end can have the first electrical conductor for the electrical signal and can have the ground conductor for the ground signal. For example, the first electrical conductor can be movable between an extended position and a retracted position on the first end of the holder, and the first electrical conductor can include a spring biasing the first electrical conductor toward the extended position. For its part, the ground conductor can be movable between an extended position and a retracted position on the first end of the holder, and the ground conductor can include a spring biasing the ground conductor toward the extended position.

A second end of the holder can also be configured to support the holder in the longitudinal passage. The second end can have a second electrical conductor for the electrical signal. A body conductor can be disposed in the longitudinal passage and can be disposed in electrical communication with the second electrical conductor.

The perforating gun can include a switch and a detonator. The switch can be configured to position in the longitudinal passage and can be disposed in electrical communication with the electrical signal and the ground signal. The detonator can also be configured to position in the longitudinal passage and can disposed in electrical communication with the switch. The switch can include a plurality of contacts, at least including: a first telemetry contact for the electrical signal disposed in electrical communication with the first electrical conductor; a second telemetry contact for the electrical signal disposed in electrical communication with a body conductor, the body conductor disposed in the longitudinal passage and disposed in electrical communication with a second electrical conductor; a ground contact disposed in electrical communication with the ground signal; a hot detonator contact disposed in electrical communication with the detonator; and a ground detonator contact disposed in electrical communication with the detonator. One or more of the contacts of the switch can include a non-wired conductive interface.

The holder can include an end fitting configured to adjust a rotational orientation of the holder about the longitudinal axis in the longitudinal passage of the carrier. The end fitting can include first and second supports. The first support can be disposed on an end of the holder and can have a first mating surface. The second support can be disposed adjacent to the first support and can have a second mating surface. The second support can be configured to fit in a set rotational orientation relative to the carrier and can be configured to support the end of the holder in the longitudinal passage. The first and second mating surfaces can have a mating feature configured to mate the first and second mating surfaces at different rotational orientations relative to one another. The at least one elastic conductor can be elastic at least in the rotational direction about the longitudinal axis of the holder in response to a change in the rotational orientation between the holder relative to the carrier.

The holder can include a weight being offset from the longitudinal axis of the holder. The holder can also include a bearing assembly disposed concentrically about the longitudinal axis of the holder and supporting the longitudinal axis of the holder aligned along a longitudinal center axis of the carrier. The bearing assembly can be configured to adjust a rotational orientation of the holder relative to the carrier based on gravity acting on the weight. Again, the at least one elastic conductor can be elastic at least in the rotational direction about the longitudinal axis of the holder in response to a change in the rotational orientation between the holder relative to the carrier.

In another configuration, a perforating gun can include a carrier and a holder. The carrier can define a longitudinal passage therethrough. The holder can have one or more charge receptacles. The holder can have a longitudinal axis and can be configured to position in the longitudinal passage. A first end of the holder can have a first bearing assembly disposed concentrically about the longitudinal axis of the holder. The first bearing assembly can support the longitudinal axis of the holder aligned along a longitudinal center axis of the carrier and can be configured to adjust a rotational orientation of the holder about the longitudinal axis relative to the carrier. The first end can also have a first electrical conductor for an electrical signal and can have a ground conductor for a ground signal. At least one elastic conductor can extend between the holder and the longitudinal passage. The at least one elastic conductor can be elastic at least in a rotational direction about the longitudinal axis of the holder in response to a change in the rotational orientation between the holder relative to the carrier. The at least one elastic conductor can be disposed in electrical communication with the carrier and the ground signal.

The described implementations can also include one or more of the following features. The holder can include a weight being offset from the longitudinal axis of the holder, and the first bearing assembly can be configured to adjust the rotational orientation of the holder relative to the carrier based on gravity acting on the weight. A second end of the holder can include a second bearing assembly being configured to support the holder in the longitudinal passage. The second end can have a second electrical conductor for the electrical signal. The first and second ends of the holder can be connected together at an intermediate connection, one of the first and second ends can have the weight, and the intermediate connection can be configured to adjust a rotational position of the first end relative to the second end about the longitudinal axis of the holder.

Some implementations disclosed herein relate to a method of assembling a system of perforating guns. The method can comprises not necessarily in sequence: assembling an assembled perforating gun; coupling a gun carrier at an end connection to the assembled perforating gun; sealing off longitudinal passages between the gun carrier and the assembled perforating gun at the end connection using a bulkhead, the bulkhead having a feedthrough conductor, the feedthrough conductor being configured to electrically conduct an electrical signal across the end connection; placing a first electrical conductor on a charge assembly in electrical contact with the feedthrough conductor by positioning the charge assembly in a longitudinal direction in the longitudinal passage of the gun carrier; and grounding between the gun carrier and a ground conductor on the charge assembly by elastically engaging at least one elastic conductor extending between the charge assembly and the longitudinal passage of the gun carrier.

Positioning the charge assembly in the longitudinal direction in the longitudinal passage of the gun carrier can comprise: supporting the charge assembly in the longitudinal passage of the gun carrier using first and second end fittings disposed on first and second ends of a charge holder; setting a rotational orientation of the second end fitting relative to the charge holder; placing the first end fitting in the longitudinal passage to support the first end of the charge holder; and engaging the second end fitting in a set position in the longitudinal passage to support the second end of the charge holder.

Positioning the charge assembly in the longitudinal direction in the longitudinal passage of the gun carrier can comprise: supporting the charge assembly in the longitudinal passage of the gun carrier using first and second bearing assemblies disposed on first and second ends of a charge holder; and permitting the charge holder to rotate in the longitudinal passage about the first and second bearing assemblies.

The foregoing summary is not intended to summarize each potential embodiment or every aspect of the present disclosure.

BRIEF DESCRIPTION OF THE DRAWINGS

FIGS. 7F-1 through 7F-5 illustrate schematic end views of different grounding assemblies according to the present disclosure.

DETAILED DESCRIPTION OF THE DISCLOSURE

Figure 1A:
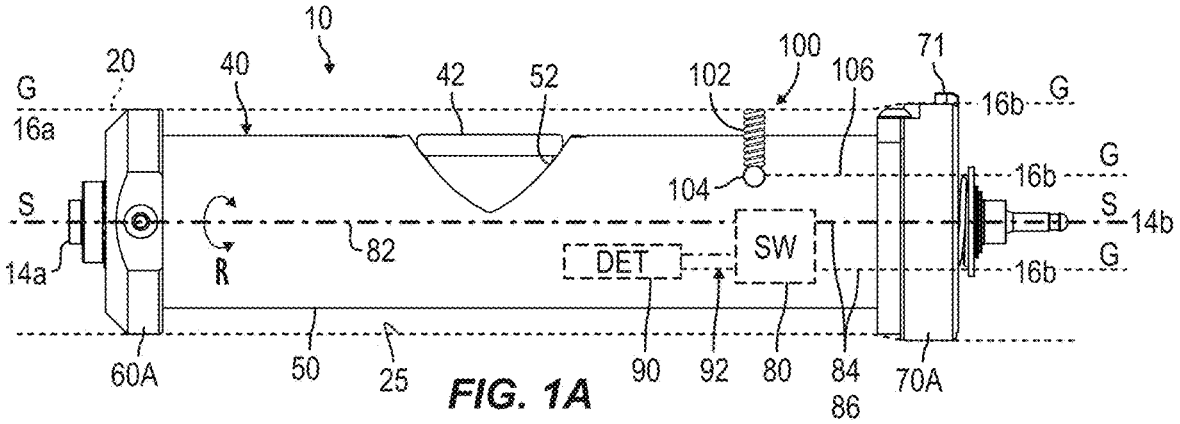
FIG. 1A illustrates an elevational view of a first charge assembly for a perforating gun having a grounding assembly according to the present disclosure.

FIG. 1A illustrates an elevational view of a first example charge assembly 40 for a perforating gun 10 having a grounding assembly 100 according to the present disclosure. The perforating gun 10 includes a carrier or housing 20, and the charge assembly 40 includes a charge holder or tube 50. End fittings 60A, 70A are disposed on ends of the charge holder 50.

The carrier 20 defines a longitudinal passage 25 therethrough, and the charge holder assembly 40 positions in the longitudinal passage 25. The charge holder 50 has one or more charge receptacles 52 for holding one or more shaped charges 42. One end fitting 60A is disposed on one end of the charge holder 50 and support the end of the charge holder 50 in the carrier's passage 25. Another end fitting 70A is disposed on the opposite end of the charge holder 50 and support the opposite end of the charge holder 50 in the carrier's passage 25. In one arrangement, the end fitting 60A is the uphole end fitting, and the other end fitting 70A is the downhole end fitting.

The uphole end fitting 60A has an electrical conductor 14*a* for an electrical signal (S). The downhole end fitting 70A also has an electrical conductor 14*b* for an electrical signal (S) and has a ground conductor 16*c* for a ground signal (G). The electrical conductors 14*a-b* can be movable between an extended position and a retracted position, and a spring can bias the electrical conductors 14*a-b* toward the extended position. The ground conductor 16*c* can also movable between an extended position and a retracted position, and a spring can bias the ground conductor 16*c* toward the extended position.

During operation, an electrical signal (S) is telemetered to the perforating gun 10 at the uphole conductor 14*a*. The electrical signal (S) is used to fire the perforating gun 10 by activating a detonator 90 to detonate the one or more shape charges 42. The detonator 90 is disposed in the carrier's passage 25 and is electrically activated to initiate detonation of the one or more shape charges 42 as is conventionally practiced. The telemetered electrical signal (S) is passed from the perforating gun 10 at the downhole conductor 14*b* to pass on to other downhole components, such as additional guns on a gun string.

Grounding is provided to the perforating gun 10 and the charge assembly 40 through the carrier 20. In particular, a ground signal (G) is conducted by an uphole grounded connection 16*a* of the carrier 20 to another gun's carrier, a bulkhead, or the like. The carrier 20 conducts this ground signal (G) along the perforating gun 10, and the grounding is provided via a downhole grounded connection 16*b* of the carrier 20 to another gun's carrier, a bulkhead, or the like. Meanwhile, the grounding from the downhole grounded connection 16*b* of the carrier 20 is provided through a ground conductor 16*c* on the downhole end fitting 70A so the charge assembly 40 and components of the perforating gun 10 can be grounded.

In one arrangement, the perforating gun 10 can use an addressable switch 80 as shown to control detonation of the detonator 90 when the perforating gun 10 is used with other guns on a gun string. The addressable switch 80 is disposed in the carrier's passage 25 and connects via a body conductor 82 to the uphole conductor 14*a* to receive the telemetered electrical signal (S) from uphole.

As described below, the body conductor 82 can be a wired conductor that runs through the carrier's passage 25. Alternatively, the charge holder 50 can use a conductive trace or another non-wired interface for the body conductor 82. For example, the charge holder 50 can define a groove, and the body conductor 82 can include a wireless conductor disposed within the groove. As also described below, the charge holder 50 can support the switch 80 and the detonator 90 thereon. Alternatively, the end fitting 70A can hold the switch 80 and detonator 90.

During operation, an electrical signal (S) telemetered to the perforating gun 10 at the uphole conductor 14*a* passes via the body conductor 82 to a first telemetry contact for the electrical signal (S) of the switch 80. A second telemetry contact for the switch 80 conducts the electrical signal (S) via an electrical connection 84 to the electrical conductor 14*b* on the downhole end fitting 70A. Meanwhile, a ground contact of the switch 80 is disposed in electrical communication via a ground connection 86 to the ground signal (G) from the ground conductor 16*c* on the downhole end fitting 70A. Hot and ground detonator contacts of the switch 80 are disposed in electrical communication via connections 92 to the detonator 90.

To improve the grounding of the perforating gun 10, a grounding assembly 100 grounds between the charge holder 50 and the carrier 20. Instead of relying entirely on grounding via the downhole grounded connection 16*b* of the carrier 20, the charge holder 50 can be grounded to the carrier 20 using the grounding assembly 100 disposed in the longitudinal passage 25 between the internal charge holder 50 and the external carrier 20.

As briefly shown here, the grounding assembly 100 includes at least one conductor 102 attached to the charge holder 50 at points 104. The at least one conductor 102 is engaged laterally relative to the longitudinal passage 25. At the same time, the at least one conductor 102 is disposed in electrical communication with the carrier 20, which conducts the ground signal (G) from uphole grounded connection 16*a*.

The at least one conductor 102 can be one or more of: elastic, supple, flexible, non-rigid, adaptable, and the like. For example, being supple, the at least one elastic conductor 102 can bend and move easily when subjected to external forces so the at least one elastic conductor is not rigid or constricted and can be readily changed, bent, expanded, or contracted. In particular, the at least one elastic conductor 102 can preferably bend and move easily in a rotational or angular direction R of rotation or turning of the charge holder 50 about the longitudinal axis A relative to the carrier 20. At the same time, being elastic, the at least one elastic conductor 102 tends to return to its former shape after external forces are removed. Being flexible, the at least one elastic conductor 102 being easily stretched or expanded (or squeezed or compressed) and can resume to its former shape after external forces are removed.

When disposed on the charge holder 50 and engaged with the inside surface of the carrier's passage 25, the at least one elastic conductor 102 is elastic (e.g., flexible) at least in a rotational direction R. This rotational direction R is transverse (e.g., lying across, set crosswise, at a right angle, etc.) to the longitudinal axis A of the charge holder 50 about which the charge holder 50 turned, oriented, or rotated. The at least one elastic conductor 102 can also be flexible at least in an inward direction toward the charge holder 50.

When the charge holder 50 is turned, oriented, or rotated inside the carrier 20, for example, the at least one elastic conductor 102 is intended to flex and bend elastically as it sweeps radially against the passage's inside surface while maintaining conductive contact between the charge holder 50 (or ground signal) and carrier 20. The flexing can reduce friction between the element 102 and the carrier's passage 25 so as to not impede the turning, orienting, or rotating of the charge holder 50 during setup or operation. Being elastic (e.g., flexible) at least in the rotational direction R, the at least one elastic conductor 102 disclosed herein is differentiated from the conventional arrangement that uses a leaf spring oriented along a longitudinal axis of a holder that allows for insertion of the holder into a carrier but produces a great deal of friction. To further reduce possible friction, the lateral sides of the at least one elastic conductor 102 are preferably rounded, tapered, chamfered, etc.

Grounding for the at least one elastic conductor 102 is also provided by a ground connection 106 to the downhole grounded connection 16*b* of the downhole end fitting 70A. This ground connection 106 can be provided using a wire, a non-wired trace, or other conductive element. Additionally, this ground connection 106 can also be provided using the charge holder 50, which can be composed of conductive material in some arrangements.

In one arrangement, for example, the charge holder 50 may be comprised of a conductive material configured to conduct the ground signal (G). A wire or a wireless contact for the ground connection 106 can conduct the ground signal (G) between the ground conductor 16*c* and the charge holder 50. The conductive material of the charge holder 50 can then conduct the ground signal (G) to the elastic conductor 102 attached at point 104. Alternatively, the charge holder 50 may be comprised of a non-conductive material. A wire or a wireless trace for the ground connection 106 can conduct the ground signal (S) between the ground connection 106 and the at least one elastic conductor 102. For example, the wire or wireless trace for the ground connection 106 can connect to the point 104 and can be in electrical communication with the elastic conductor 102.

In FIG. 1A, the charge assembly 40 is configured to position in a defined rotational orientation within the carrier 20. Accordingly, the end fittings 60A, 70A are attached in fixed relation to the charge holder 50, and an orientation point 71 (e.g., locator or tab) on the downhole end fitting 70A engages inside the carrier 20 at a set orientation. Other arrangements can be used and can benefit from the grounding assembly 100 of the present disclosure.

Figure 1B:
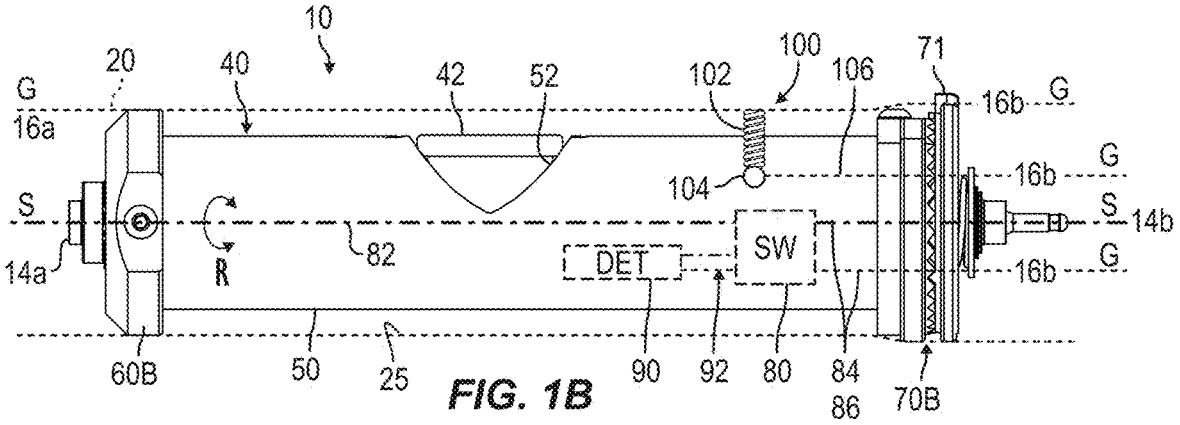
FIG. 1B illustrates an elevational view of a second charge assembly for a perforating gun having a grounding assembly according to the present disclosure.

In particular, FIG. 1B illustrates an elevational view of a second example charge assembly 40 for a perforating gun 10 having a grounding assembly 100 according to the present disclosure. This arrangement is similar to that discussed in FIG. 1B so that similar reference numerals are used for comparable components. In this arrangement, the charge assembly 40 is configured to position in a configurable rotational orientation within the carrier 20. Accordingly, the uphole end fitting 60B can be attached in fixed relation to the charge holder 50. However, the downhole end fitting 70B attached to the other end of the charge holder 50 has an orientation point 71 (e.g., locator or tab) that can be rotated and set at a desired orientation to engage inside the carrier 20.

Figure 1C:
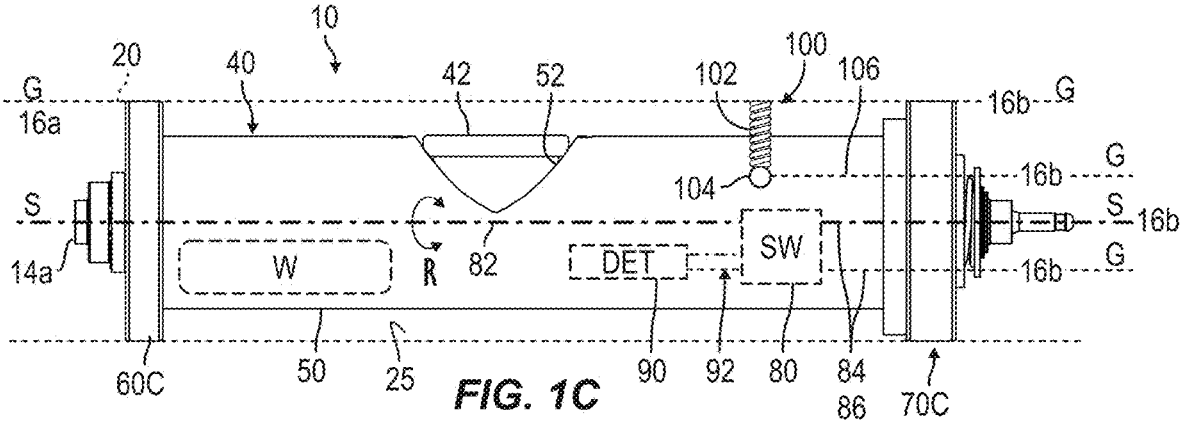
FIG. 1C illustrates an elevational view of a third charge assembly for a perforating gun having a grounding assembly according to the present disclosure.

In yet another arrangement, a charge assembly 40 of FIG. 1C is configured to rotate within the carrier 20. Again, this arrangement is similar to that discussed in FIGS. 1A-1B so that similar reference numerals are used for comparable components. The end fittings 60C and 70C include bearing assemblies that allow the charge holder 50 to rotate inside the carrier 20. The charge holder 50 includes a weight (W) offset from the longitudinal axis of the perforating gun 10 so the charge holder 50 can orient relative to gravity.

Each of the above arrangements can benefit from the grounding assembly 100. For instance, each arrangement benefits from the additional grounding path provided by the grounding assembly 100 connected between the carrier 20 and the charge holder 50. Additionally, the laterally arranged elastic conductors 102 can flex and adjust for internal contact inside the carrier 20 during assembly of the perforating gun 10—namely, when the charge assembly 40 is inserted into the carrier's passage 25. Furthermore, the elastic conductor 102 engaged laterally relative to the longitudinal passage 25 can contact inside the carrier's passage 25 with less friction and resistance when the charge holder 50 is oriented or rotated about the longitudinal axis inside the carrier 20. This is especially true for the arrangements of FIGS. 1B and 1C.

Figure 2A:
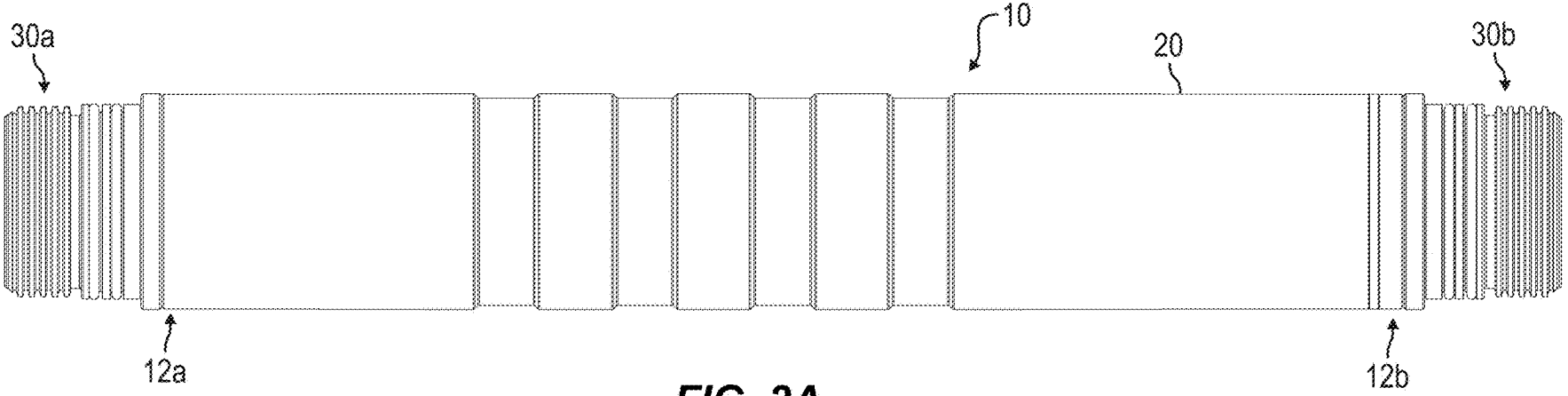
FIG. 2A illustrates an elevational view of a first perforating gun according to the present disclosure.
Figure 2B:
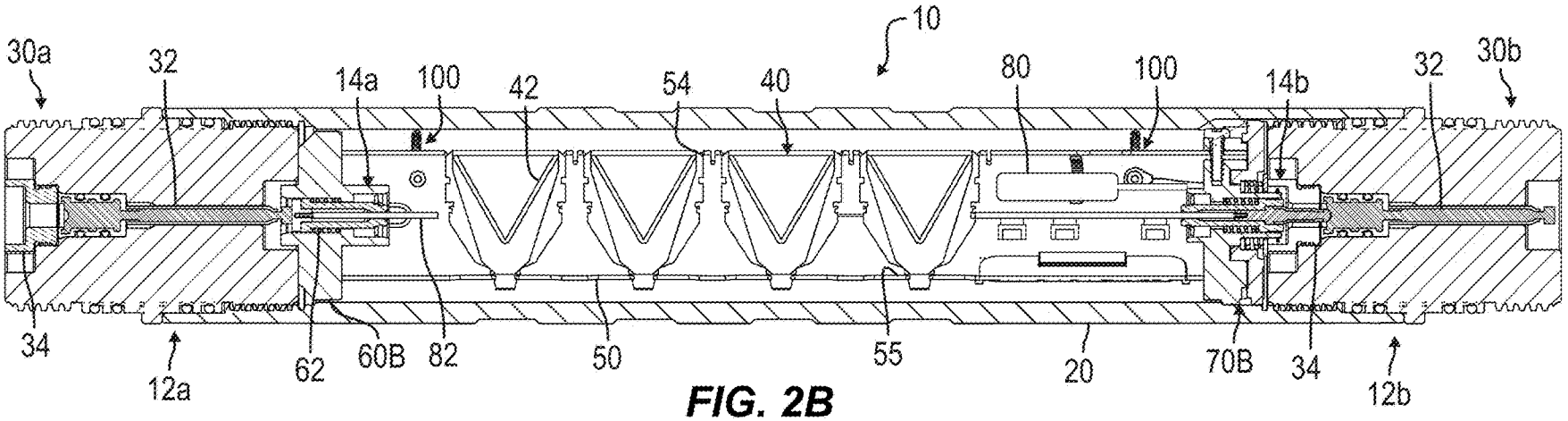
FIG. 2B illustrates a cross-sectional view of the disclosed perforating gun.

FIG. 2A illustrates an elevational view of a first example of a perforating gun 10 according to the present disclosure, and FIG. 2B illustrates a cross-sectional view of the disclosed perforating gun 10. This perforating gun is similar to that discussed above with reference to FIG. 1B. Further details related to this perforating gun 10 can be found in U.S. application Ser. No. 18/130,823 filed Apr. 4, 2023, which is incorporated herein by reference in its entirety.

As will be appreciated, the perforating gun 10 can be used on a perforating gun string in which the perforating gun 10 is interconnected to other perforating guns or components. In the present example, intermediate (a.k.a. tandem or reusable) subcomponents or bulkheads 30*a-b* are used to connect the perforating gun 10 to other perforating guns or components on the gun string. As discussed below, other configurations are possible in which the bulkheads 30*a-b* are not used.

The perforating gun 10 has an upper or uphole end 12*a* and has a lower or downhole end 12*b*. As will be appreciated, the terms uphole and downhole used throughout the present disclosure simply refer to the way the perforating gun 10 is assembled and deployed in a wellbore. In general, the perforating gun 10 includes (i) a housing or carrier 20 having a longitudinal passage or bore 25 extending axially therethrough, (ii) a charge assembly 40 configured to carry one or more explosive elements (e.g., shaped charges) 42, and (iii) one or more detonators (not shown) for igniting the shaped charges 42 as desired, such as through one or more detonation cords (not shown). The detonator (not shown) of the perforating gun 10 can be actuated by a dedicated controller or switch 80, which may include one or more printed circuit boards (PCB) configured to provide electrical signals to the detonator (not shown) to set off the shaped charges 42. Details related to a switch assembly, detonator, detonator chord, and the like can be found in U.S. application Ser. No. 17/831,900 filed Jun. 3, 2022; U.S. application Ser. No. 16/293,508 filed Mar. 5, 2019; and U.S. application Ser. No. 18/317,485 filed May 15, 2023, each of which is incorporated herein by reference in its entirety.

Electric signals are normally provided downhole to the gun string from the surface, such as via a wireline. The electric current is then provided to each gun's associated switch 80 and detonator (not shown). The electric signals can also be further provided through each perforating gun 10 of the gun string to the next successive downhole perforating gun 10 (or other tool or component), if any, on the gun string. To pass the electric signals between components, the perforating gun 10 uses multiple conductive electrical components in the gun string at various conductive interfaces 14 formed therebetween. For example, electric signals is typically provided to each switch 80 via one or more inner body conductors 82 associated with the charge assembly 40. Various wires or inner conductors connect to and connect from the switch 80 for the electrical control of the perforating gun 10. The electric signals are then typically provided to the next successive downhole perforating gun 10 via a feedthrough at the conductive interfaces 14*a-b*.

Preferably, the conductive interfaces 14*a-b* established between the perforating guns 10 for the electric signal pathway is non-wired. In fact, the entire perforating gun 10 may be wire-free (i.e., having non-wired interfaces or pathways), which can eliminate the need for connecting or soldering wires. In particular, one or more pairs of non-wired electrical components abut one another to form the desired conductive interfaces 14*a-b* within the perforating gun 10. These components can have non-wired, plug-jack, ball-socket, or biased electrical connections or any other suitable arrangement of parts to create one or more non-wired interfaces 14*a-b*.

Figure 3:
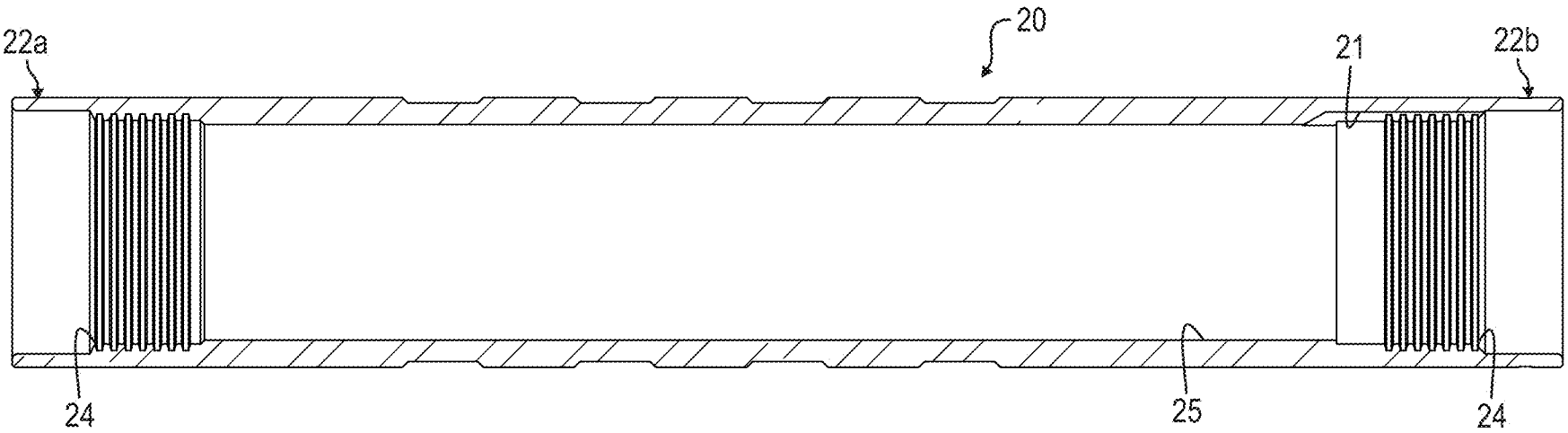
FIG. 3 illustrates a cross-sectional view of a carrier for the disclosed perforating gun.

As noted, the perforating gun 10 includes a carrier 20, which can be a tube, having the longitudinal passage 25 in which the charge assembly 40 is supported. (FIG. 3 illustrates an isolated cross-sectional view of the carrier 20 for further reference). The carrier 20 can be composed of a suitable material, such as a metallic material for use downhole. Internal thread 24 is defined in the internal passage 25 toward the uphole and downhole ends 22*a-b* of the carrier 20. The thread 24 is used for connecting the perforating gun 10 to other components, such as connecting to tandem subcomponents or bulkheads 30*a-b*, other perforating guns, and the like of a gun string. As noted, the perforating gun 10 in the present example uses the intermediate bulkheads 30*a-b* to connect the perforating gun 10 to other guns or components of a gun string. Therefore, the carrier's thread 24 threads onto the bulkheads 30*a-b*. As shown, the bulkheads 30*a-b* include thread 31 and seals 33 for the connection with the carrier 20.

The charge assembly 40 mounted inside the internal passage 25 of the carrier 20 includes a charge holder 50 and end fittings 60B, 70B. (FIG. 3 illustrates an isolated view of the internal charge assembly 40 for further reference.) The charge holder 50 is configured to position in the longitudinal passage 25 of the carrier 20 and is supported by the end fittings 60B, 70B.

The charge holder 50 can be tubular as shown or can have other shapes. The charge holder 50 can be composed of any suitable material, such as a metal or plastic material. The charge holder 50 has first and second ends 52*a-b* and has one or more charge receptacles 54. As shown in FIG. 2B, the charge receptacles 54 are configured to support explosive shaped charges 42.

The shaped charges 42 supported in the charge holder 50 are oriented outward toward the surface of the carrier 20's inner passage 25. The shaped charges 42 can be disposed in line with one another so the shaped charges 42 are oriented in the same direction relative to one another. As will be appreciated, more or fewer receptacles 54 and shaped charges 42 can be provided, depending on the length of the perforating gun 10 and the size of the shaped charges 42. Additionally, the receptacles 54 and the shaped charges 42 can be oriented in one or more orientations relative to one another.

The radial orientation of the shaped charges 42 and the charge holder 50 can be adjusted inside the carrier 20 using the second (downhole) end fitting 70B as discussed below.

Looking first at the first end fitting 60B as shown in FIG. 2B, the first end fitting 60B is disposed on the first end 52*a* of the charge holder 50 and is configured to support the first end 52*a* of the charge holder 50 in the internal passage 25 of the carrier 20. For example, a fixture 53*a*, such as a bolt or a screw, can affix the first end 52*a* of the charge holder 50 to the first end fitting 60.

The uphole end fitting 60B has a circumferential edge that engages inside the carrier 20's inner passage 25. In general, the uphole end fitting 60B can be set at any desired rotational orientation inside the carrier 20's inner passage 25. The uphole end fitting 60B can be composed of a suitable material. For example, the uphole end fitting 60B can be composed of a non-conductive material, such as a thermoplastic material.

The uphole end fitting 60B includes a first electrical conductor 62 disposed therethrough. Being part of the conductive interface for the conductor 14*a*, the first electrical conductor 62 provides an electrical connection from inside the perforating gun 10 to the subcomponent's feedthrough conductor 32, which in turn provides an electrical connection to another gun or another component of a gun assembly.

The downhole end fitting 70B can also be composed of a suitable material, such as a thermoplastic. The downhole end fitting 70B also has a circumferential edge that engages inside the carrier 20's inner passage 25. Moreover, the downhole end fitting 70B also has a second electrical conductor or sleeve 75*b* disposed therethrough. Being part of the conductive interface of the conductor 14*b*, the second electrical conductor or sleeve 75*b* also provides an electrical connection from inside the perforating gun 10 to the subcomponent's feedthrough conductor 32, which in turn provides an electrical connection to another gun or another component of a gun string.

In general, the downhole end fitting 70B fits in a set, fixed, or predetermined condition inside the carrier 20's inner passage 25. For example, the internal passage 25 of the carrier 20 has at least one location 27, and the downhole end fitting 70B has at least one locator 71 configured to locate at least one location 21 of the internal passage 25. For example, the at least one location 21 can include a slot defined in the internal passage 25, and the at least one locator 71 can include a tab protruding from the edge of the downhole end fitting 70B and configured to position in the slot 21.

Although the downhole end fitting 70B fits in the set orientation using the slot 21 and tab 71, the downhole end fitting 70B allows the charge holder 50 to be adjusted and locked in a desired orientation about the longitudinal axis of the perforating gun 10 so that the direction of the one or more shaped charges 42 can be set at a particular orientation relative to the carrier 20 and other guns connected thereto. In other words, the shaped charges 42 can be set at a desired orientation relative to the carrier's threads 24, which defines how the carrier 20 affixes relative to other perforating guns using the bulkheads 30*a-b*.

The electrical conductor or pin 75*a* of the downhole end fitting 70B makes an electrical connection with the feedthrough conductor (32) on the connected subcomponent or bulkhead (30*b*). Meanwhile, a ground conductor 76*a-c* on the end fitting 70B makes an electrical ground connection with a ground contact (34) of the connected bulkhead (30*b*). The feedthrough conductor (32) is electrically isolated from the body of the bulkhead 30*b*, which can be composed of a metal material. The ground contact (34) is electrically isolated from the feedthrough conductor (32), but the ground contact (34) is in electrical contact with the body of the bulkhead 30*b* and the connected carriers 20 for the purposes of grounding.

Figure 5A:
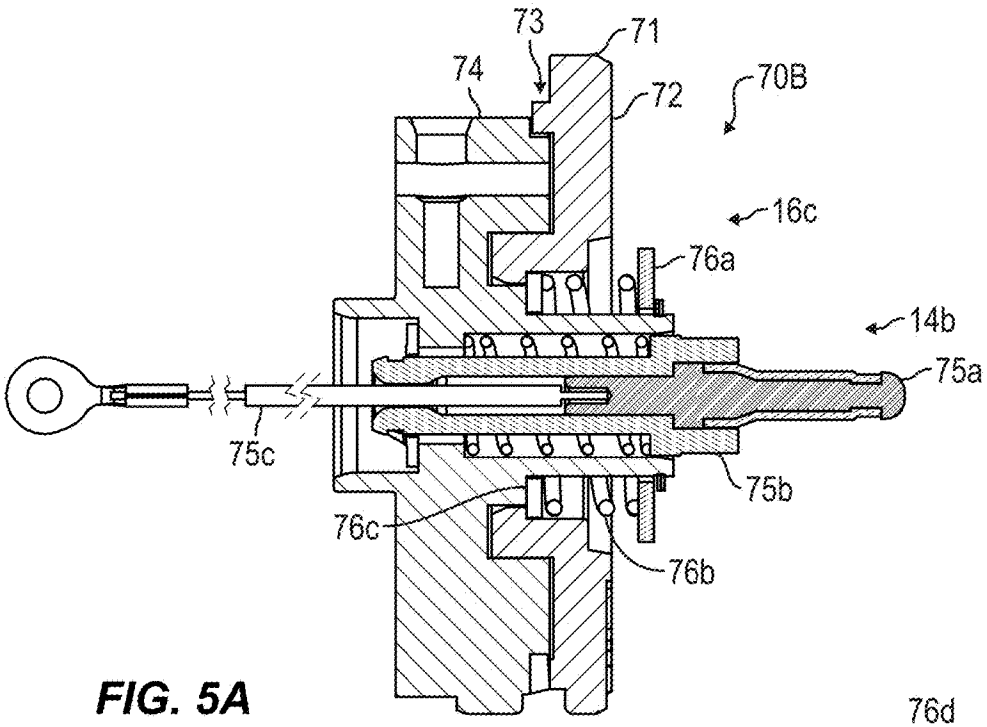
FIG. 5A illustrates a detailed cross-sectional view of an end fitting for the disclosed perforating gun.
Figure 5B:
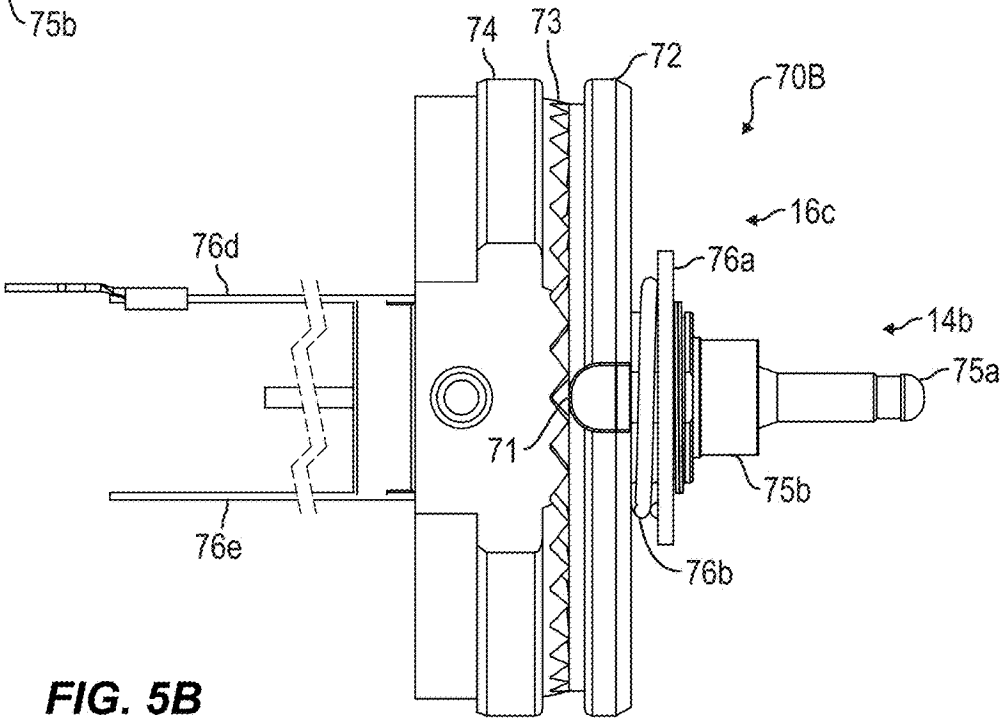
FIG. 5B illustrates a detailed top view of the disclosed end fitting.

Looking at the downhole end fitting 70B in more detail, FIG. 5A illustrates a cross-sectional view of the downhole end fitting 70B, and FIG. 5B illustrates a top view of the downhole end fitting 70B. The downhole end fitting 70B includes a first support 72 and a second support 74 that are mated together to lock their rotational orientation. The second support 74 is an "inner" support and is affixed to the downhole end 52*b* of the charge holder 50 using a fastener or the like. The second support 74 has an outer edge that can rest inside the carrier's passage 25 at any particular orientation.

The first support 72 is an "outer" support and is a separate component from the inner support 74. The outer support 72 also has an outer edge that can rest inside the carrier's passage 25. However, the second support 74 has a tab 71 that fits into a slot 23 of the carrier's passage 25 so the outer support 72 fits in a set, fixed, or predetermined orientation in the passage 25. For assembly of the perforating gun 10, the inner support 74 and connected charge holder 50 can have its orientation rotated relative to the set orientation between the outer support 72 and the surrounding carrier 20 to adjust the relative orientation of the shaped charges (42). Meanwhile, the interface of mating surfaces 73 between these supports 72, 74 locks their orientation in place.

The supports 72, 74 defines a central passage therethrough. The electrical conductor 14*b* comprises a holder or sleeve 75*b*, which is disposed in the central passage and which has a proximal end and a distal end. The proximal end has a catch ring or shoulder configured to engage a back surface of the inner support 74. A conductive pin 75*a* of the conductor 14*b* is disposed in the sleeve 75*b* and extends from the distal end of the sleeve 75*b* for making electrical contact with other components of the gun string. A biasing element, such as a compression spring, is disposed between a shoulder of the central opening and a shoulder of the sleeve 75*b* so that the spring biases the sleeve 75*b* away from the inner mating surface and extends the contact pin 75*a* outward from the end fitting 70B. A wire or other conductive member 75*c* connects to the contact pin 75*a* and extends from the end fitting 70B for connection to the switch (80; FIG. 2B) in the perforating gun (10).

The inner support 74 comprises a central rim extending from the mating surface 73 about the central opening. The outer support 72 defines a central opening disposed on this central rim of the inner support 74. For example, the outer support 72 has a disc shape that fits on the central rim that extends from the inner support 74.

The ground conductor 16*c* of the end fitting 100 has an inner conductive ring 76*c*, an outer conductive ring 76*a*, and a biasing element 76*b*. The inner conductive ring 76*c* is engaged with at least a portion of a back surface of the outer support 72, and the outer conductive ring 76*a* is engaged with a portion of the central rim on the inner support 74. For example, the inner ring 76*c* is engaged with shoulders of the inner and outer supports 72, 74, and the outer ring 76*a* is retained on the central rim by a retaining clip or other retainer on the central rim.

The biasing element 76*b*, which can be a compression spring, is conductive and is biased against the inner and outer conductive rings 76*a*, 76*c*. The spring 76*b* biases the mating surface 73 of the outer support 72 against the mating surface 73 of the inner support 74. The spring 76*b* and rings 76*a*, 76*c* are used for the electrical ground of the electrical connection for the gun (10). Ground wires 76*d-e* or other conductive members connect to the inner ring 76*c* and extend from the end fitting 70B. One ground wire 76*d* can connect to the charge holder (50), while the other ground wire 76*e* can connect to the switch (80). Additionally, the spring 76*b* also keeps the inner and outer supports 72, 74 mated together and engaged in a manner that keeps their relative orientation locked during assembly and handling. The biased orientation is then additionally locked in place when the downhole tandem subcomponent or bulkhead (30*b*) is assembled on the gun's carrier (20).

Figure 4:
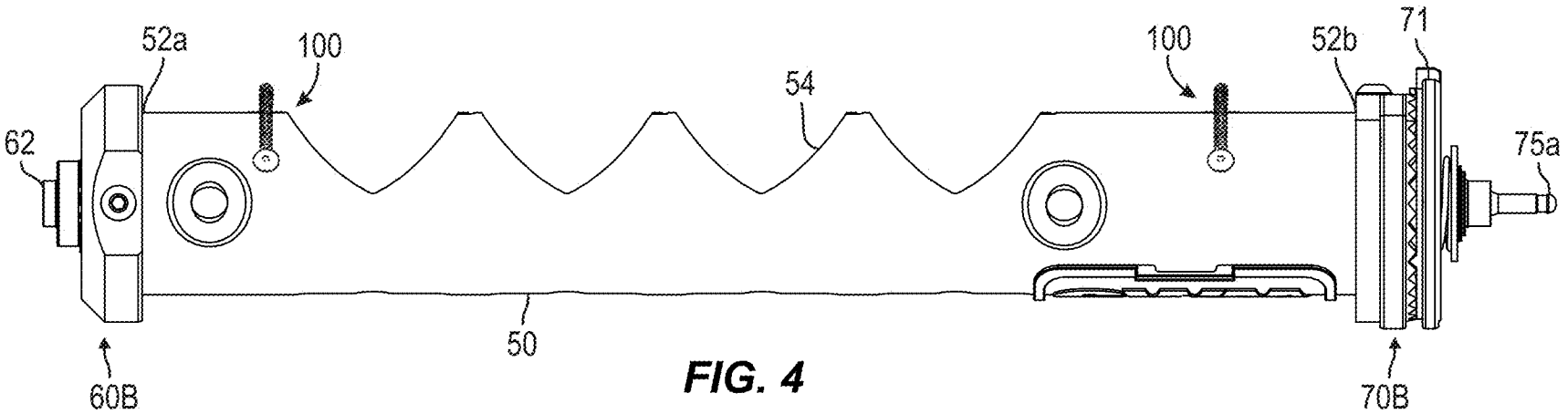
FIG. 4 illustrates an elevational view of a charge assembly for the disclosed perforating gun.

For example, when the downhole end fitting 70B is disposed adjacent to the tandem bulkhead 30*b* as shown in FIG. 4, a ground contact 34 on the tandem bulkhead 30*b* engages the outer ground ring (76*a*). The spring (76*b*) can be compressed, and the back side of the outer support 72 can have a circumferential cutout to accommodate the ring (76*c*). Electrical grounding is achieved from the ground contact 34, to the outer ring (76*a*), through the spring (76*b*), and to the inner ring (76*c*). In turn, the inner ring (76*c*) can be connected to the ground wires (76*d-e*) extending from the inner support (74) to be affixed to components inside the charge holder 50.

The mating features 76 on the mating surfaces can include a plurality of teeth disposed radially about the inner mating surfaces. Other than the radial teeth as shown, diverse types of mating features can be used between the mating surfaces 76.

In the previous embodiment of the perforating gun 10, interconnecting (a.k.a. tandem or reusable) subcomponents or bulkheads 30*a-b* are configured to thread to internal thread 24 inside the internal passage 25 on the carrier's ends 22*a-b* to connect the perforating guns 10 together in a gun string. In alternative configurations, adjacent perforating guns 10 can be directly and releasably interconnected together without the use of an intermediate subcomponents therebetween. For example, the carriers 20 of the perforating guns 10 can have tapered box and pin ends configured to thread directly together.

To improve the grounding of the perforating gun 10, one or more grounding assemblies 100 ground between the charge holder 50 and the carrier 20. As shown in FIGS. 2B and 4, the grounding assemblies 100 are attached to the charge holder 50 and extend to laterally engage inside the carrier 20 in which the charge assembly 40 is inserted. The perforating gun 10 benefits by the additional grounding paths provided by the grounding assembly 100 connected between the carrier 20 and the charge holder 50. Additionally, the laterally arranged elastic conductor 102 can flex and adjust for internal contact inside the carrier 20 during assembly of the perforating gun 10—namely, when the charge assembly 40 is inserted into the carrier's passage 25. Furthermore, the elastic conductor 102 engaged laterally relative to the longitudinal passage 25 can contact inside the carrier's passage 25 with less friction and resistance when the charge holder 50 is rotationally oriented about the longitudinal axis inside the carrier 20.

Figure 6A:
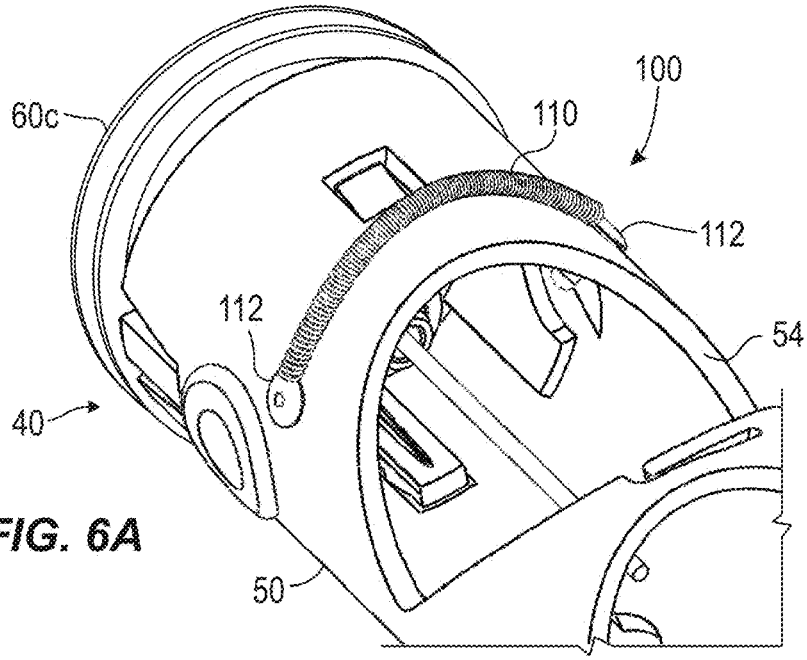
FIGS. 6A, 6B, and 6C respectively illustrate a perspective view, a side view, and a top view of a first grounding assembly disposed on a charge holder.
Figure 6B:
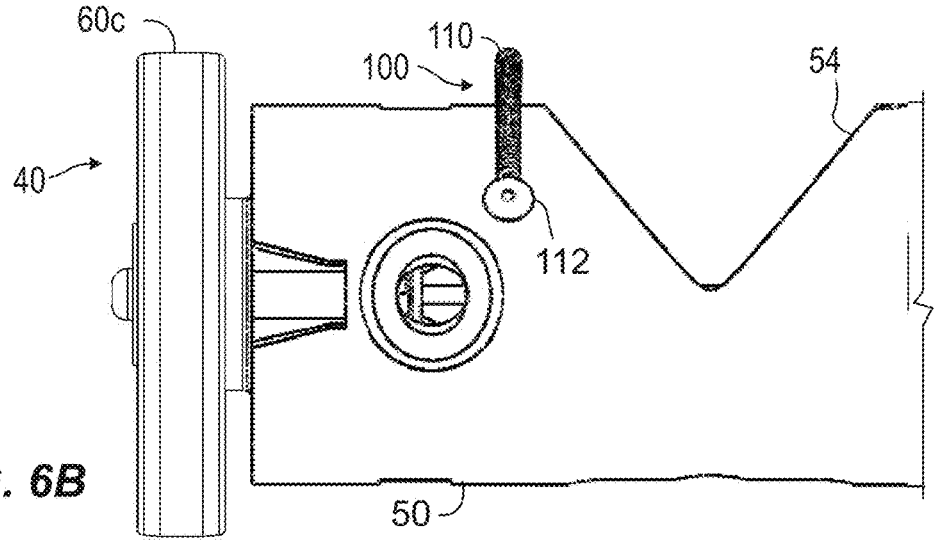
Figure 6C:
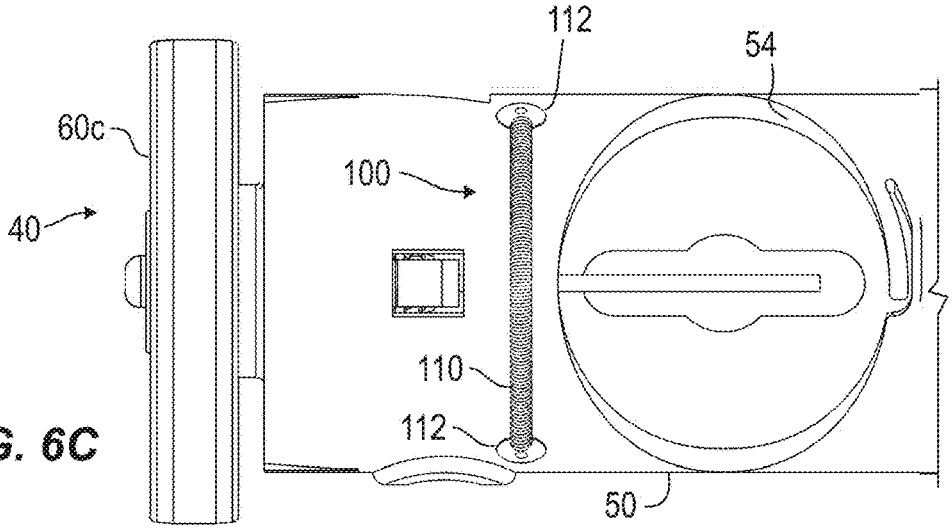

FIGS. 6A, 6B, and 6C respectively illustrate a perspective view, a side view, and a top view of an example of a grounding assembly 100 disposed on a charge holder 50. This grounding assembly 100 can be used with any of the arrangements of charge assembly 40 disclosed herein.

The grounding assembly 100 includes an elastic conductor 110 in the form of a coil spring 110—which is composed of conductive material, such as a suitable metallic material. Ends of the coil spring 110 are affixed by fasteners 112 (e.g., rivets, screws, etc.) at points on an outer circumference of the charge holder 50. As shown here, the charge holder 50 is a cylinder or tube composed of a metal material and defines cutouts for the charge receptacles 54. With the spring ends attached to respective points on the charge holder 50 by the fasteners 112, an intermediate portion or length of the coil spring 110 is biased away from the charge holder 50 so the coil spring 110 can contact inside a carrier (20). To accommodate rotational orientation of the charge holder 50 inside the carrier (20), the coil spring 110 extends laterally relative to the longitudinal axis of the charge holder 50 so the coil spring 110 can engage laterally relative to the longitudinal passage of the carrier in which the charge holder 50 positions.

Figure 7A:
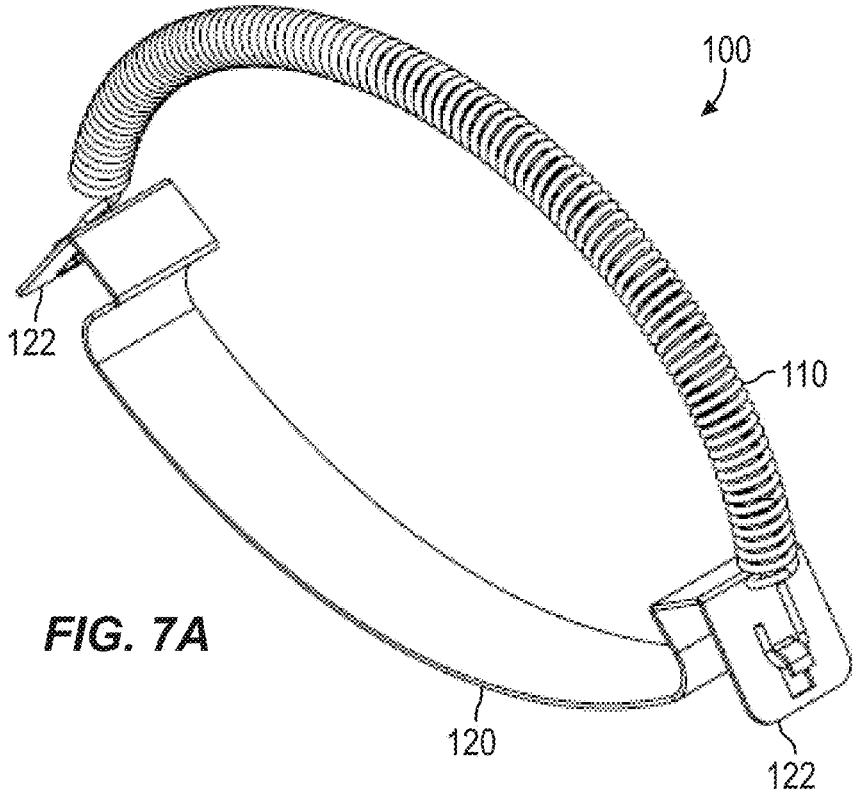
FIG. 7A illustrates a perspective view of a second grounding assembly.

FIG. 7A illustrates a perspective view of another example of a grounding assembly 100 for the disclosed grounding assembly. The grounding assembly 100 includes a coil spring 110 and a fixture 120—both of which are composed of conductive material, such as a suitable metal. The coil spring 110 has ends connected towards ends of the fixture 120. For example, hooking arrangements are shown, but other forms of connection can be used, including fasteners, welds, etc. The fixture 120 is a bow spring, but other flat components can be used to space and support the ends of the coil spring 110. Clips 122 are formed on the ends of the bow spring 120 and are configured to attach to respective points on a charge holder (50) as discussed below. As before, an intermediate portion or length of the coil spring 110 is biased away from the bow spring 120.

Figure 7B:
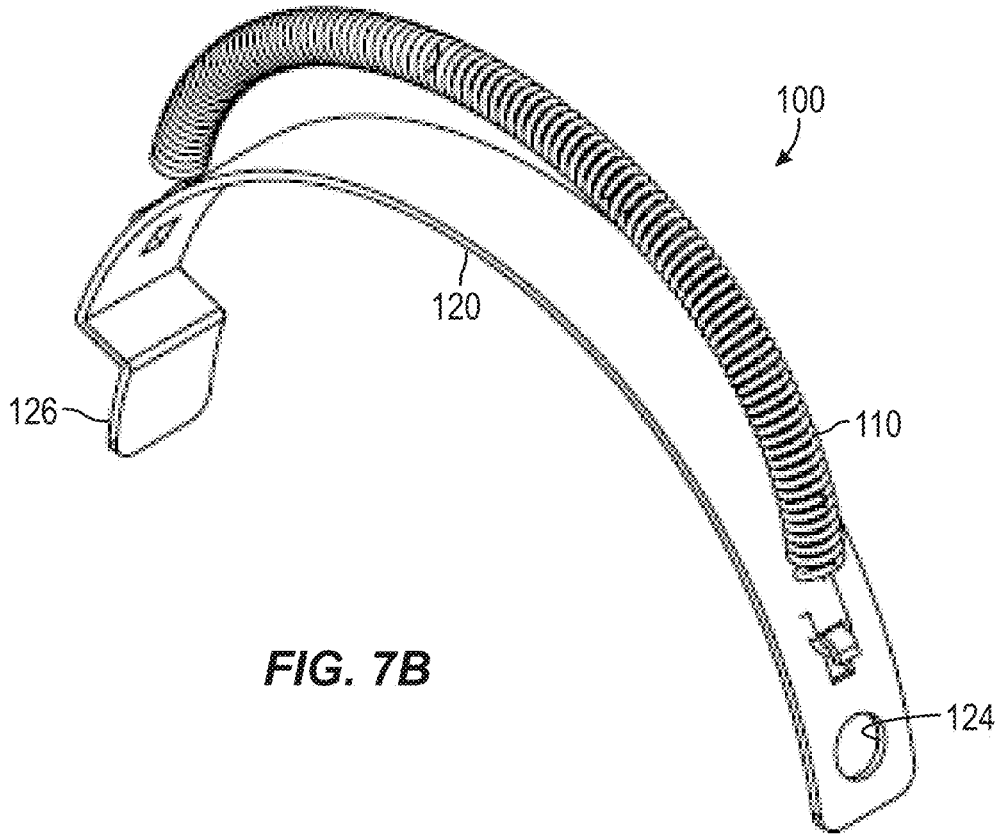
FIG. 7B illustrates a perspective view of a third grounding assembly.

FIG. 7B illustrates a perspective view of yet another example of a grounding assembly 100 for the disclosed grounding assembly. This grounding assembly 100 also includes a coil spring 110 and a bow spring 120—both of which are composed of conductive material, such as a suitable metal. The coil spring 110 has ends connected toward ends of the bow spring 120. For example, hooking arrangements are shown, but other forms of connection can be used, including fasteners, welds, etc. A hole 124 on one end of the bow spring 120 is provided to be engaged by a fastener or to fit on a tab to affix to a charge holder (50). A clip 126 is formed on the other end of the bow spring 120. The clip 126 can be L-shaped. The elements 124, 126 are configured to attach to respective points on a charge holder (50) as discussed below. As before, an intermediate portion or length of the coil spring 110 is biased away from the bow spring 120.

Figure 7C:
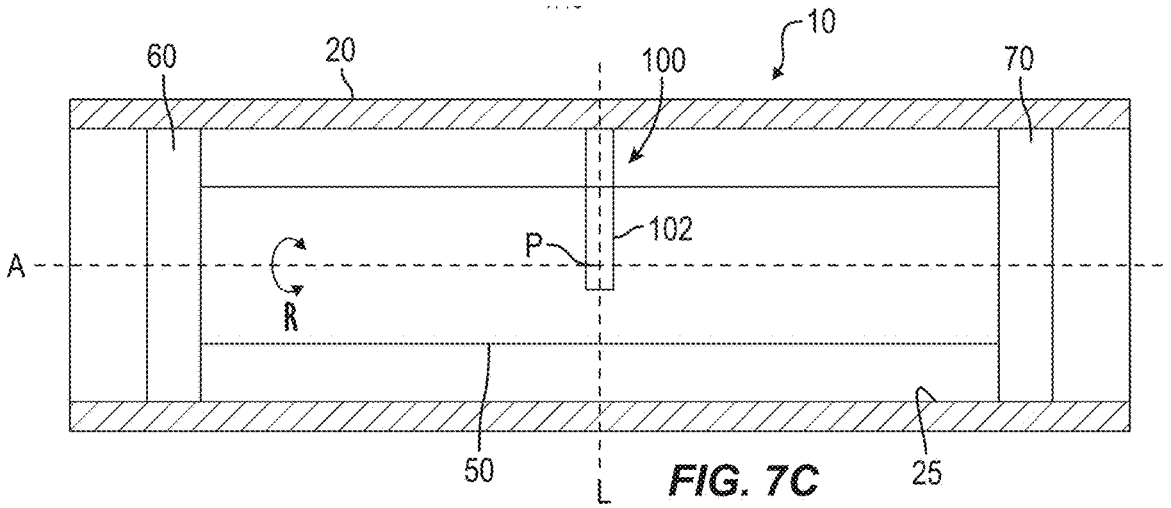
FIG. 7C illustrates a schematic view of a perforating gun having a grounding assembly.

FIG. 7C illustrates a schematic view of a perforating gun 10 having a grounding assembly 100. As disclosed here, the carrier 20 defines a longitudinal passage 25 that extends therethrough along a longitudinal axis A, and end fittings 60, 70 support the charge holder 50 in the passage 25. A grounding assembly 100 uses at least one elastic conductor 102 that extends between the charge holder 50 and the longitudinal passage 25 to conduct grounding for the carrier 20 and the charge holder 50. The at least one elastic conductor 102 extends in a direction away from the charge holder 50 toward the carrier's passage 25. (As shown here, this direction that the conductor 102 extends can be thought of being a radial direction or a lateral direction. In general, the direction of extension can be at any suitable angle relative to the longitudinal axis A.)

The grounding assembly 100 can use various form of elastic conductors 102, such as a spring, a coil spring, a compression spring, an extension spring, a bow spring, a leaf spring, a serpentine spring, a brush, a bristle, a wire, and the like. The grounding assembly 100 can use one or more of the elastic conductors 102. Although not shown in FIG. 7C, multiple elastic conductors 102 can be arranged along the length of the longitudinal axis A, and multiple elastic conductor 102 can be arranged in different rotational or angular orientations about the longitudinal axis A.

Figures 1, 7D:
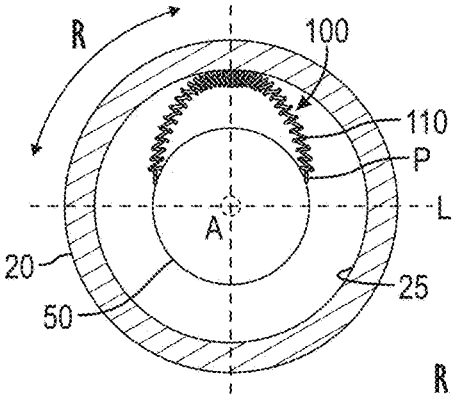
FIGS. 7D-1 through 7D-5 illustrate schematic end views of different grounding assemblies according to the present disclosure.
Figures 3, 7D:
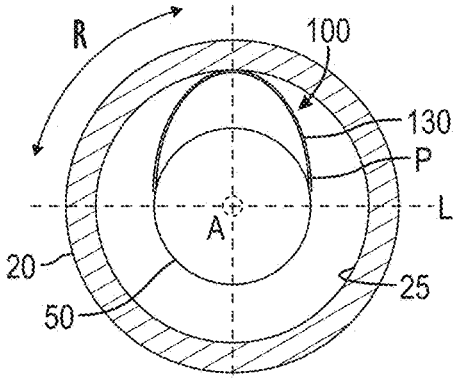
Figures 2, 7D:
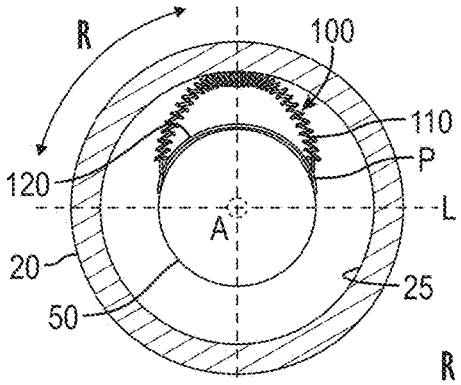
Figures 4, 7D:
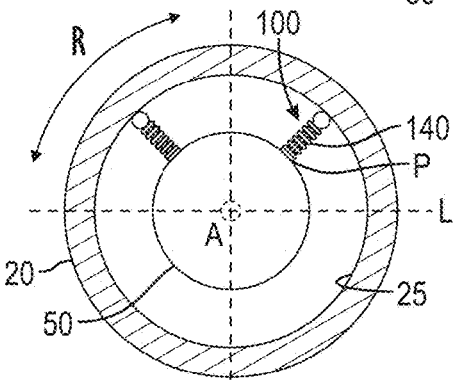
Figures 5, 7D:
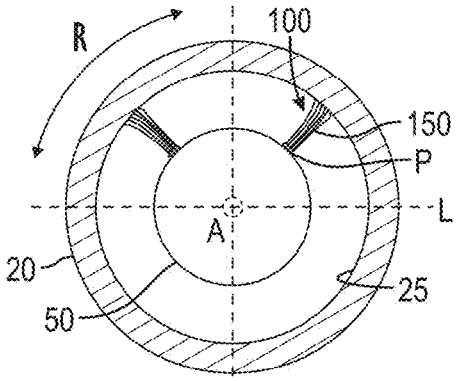

FIGS. 7D-1 through 7D-5 illustrate schematic end views of different elastic conductors for grounding assemblies 100 according to the present disclosure. In FIG. 7D-1, the elastic conductor is a spring 110, such as a coil spring, having ends affixed at points P to the charge holder 50. An intermediate portion or length of the spring 110 runs laterally across the longitudinal axis A of the charge holder 50 and is biased away from the charge holder 50 to engage the inside surface of the carrier's passage 25. In this and the other arrangements discussed below, the grounding contact from the elastic conductor (spring 110) can be maintained between the carrier 20 and the charge holder 50 without causing increased friction in a rotational direction R between the carrier 20 and the charge holder 50 when turned or rotated relative to one another about the longitudinal axis A.

In FIG. 7D-2, the elastic conductor is a spring 110, such as a coil spring, having ends affixed to a fixture 120, such as a bow spring or strip. The bow spring 120 has ends affixed at points P to the charge holder 50. An intermediate portion or length of the spring 110 runs laterally across the longitudinal axis A of the charge holder 50 and is biased away from the charge holder 50 to engage the inside surface of the carrier's passage 25.

In FIG. 7D-3, the elastic conductor is a spring 130, such as a bow spring or a leaf spring, having ends affixed at points P to the charge holder 50. An intermediate portion or length of the spring 110 runs laterally across the longitudinal axis A of the charge holder 50 and is biased away from the charge holder 50 to engage the inside surface of the carrier's passage 25.

In FIG. 7D-4, the elastic conductor is a brush 140 having an end affixed at a point P to the charge holder 50. Multiple brushes 140 can be disposed about the charge holder 50. The brush 140 as shown herein includes a spring that biases a contact, such as a ball or bearing, from the charge holder 50 to engage the inside surface of the carrier's passage 25.

In FIG. 7D-5, the elastic conductor is a brush 150 having an end affixed at a point P to the charge holder 50. Multiple brushes 150 can be disposed about the charge holder 50. The brush 150 as shown herein includes collections of supple and elastic elements, such as leaf springs, wires, bristle, etc., extending from the charge holder 50 to engage the inside surface of the carrier's passage 25.

Figure 7E:
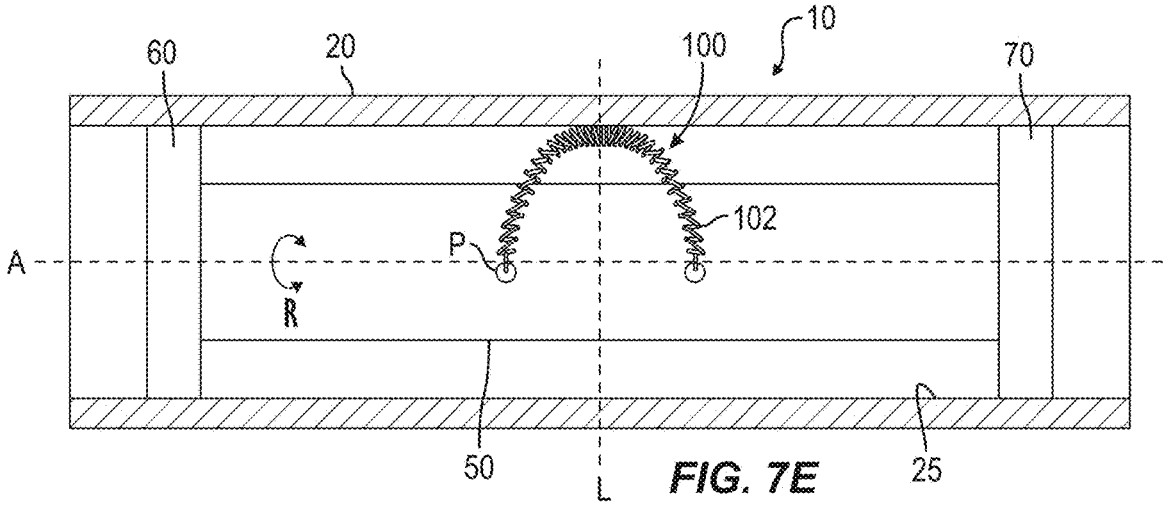
FIG. 7E illustrates a schematic view of a perforating gun having another grounding assembly.

FIG. 7E illustrates a schematic view of a perforating gun 10 having another arrangement of a grounding assembly 100. Again, the carrier 20 defines a longitudinal passage 25 that extends therethrough along a longitudinal axis A, and end fittings 60, 70 support the charge holder 50 in the passage 25. A grounding assembly 100 uses at least one elastic conductor 102 that extends between the charge holder 50 and the longitudinal passage 25 to conduct grounding for the carrier 20 and the charge holder 50. In the previous arrangements of FIG. 7C and the like, the elastic conductor 102 runs laterally across the charge holder 50 (e.g., perpendicular, across, cross-wise, diagonal, etc. relative to the longitudinal axis A) so the elastic conductor 102 can engage the carrier 20 in a lateral direction L. (The amount of lateral, cross-wise, or diagonal orientation of the at least one elastic conductor 102 can range from as great as orthogonal to as small as non-longitudinal (i.e., not parallel to or not disposed along the longitudinal axis A.) In this arrangement of FIG. 7E, the elastic conductor 102 is positioned longitudinally along the charge holder 50 and extends to engage the carrier 20.

As before, the grounding assembly 100 can use various form of elastic conductor 102, such as a spring, a coil spring, a bow spring, a leaf spring, a serpentine spring, a brush, a bristle, a wire, and the like. The grounding assembly 100 can use one or more of the elastic conductors 102. Although not shown in FIG. 7E, multiple elastic conductors 102 can be arranged along the length of the longitudinal axis A, and multiple elastic conductors 102 can be arranged in different rotational or angular orientations about the longitudinal axis A.

Figures 1, 7F:
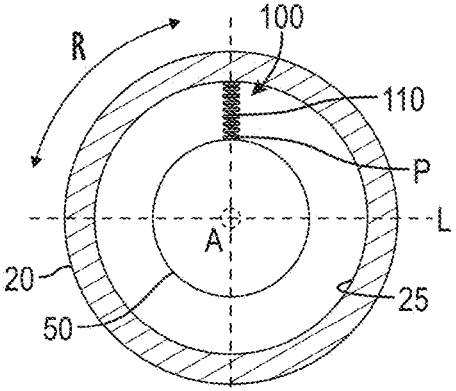
Figures 3, 7F:
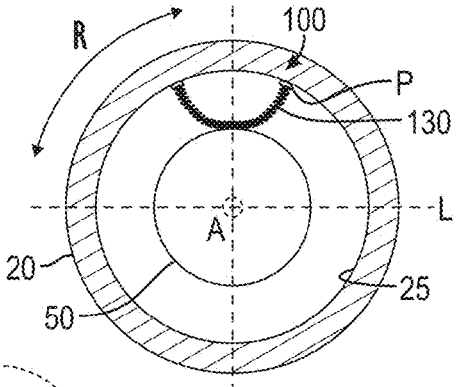
Figures 2, 7F:
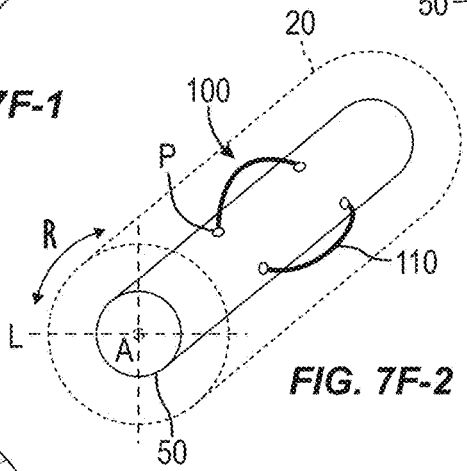
Figures 4, 7F:
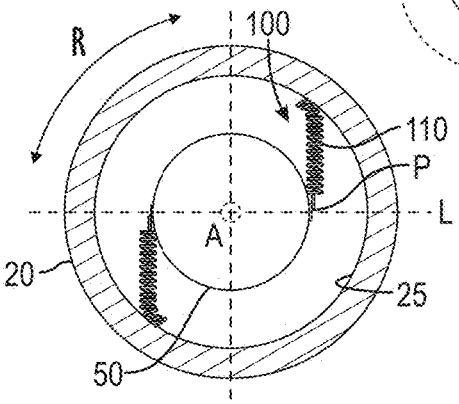
Figures 5, 7F:
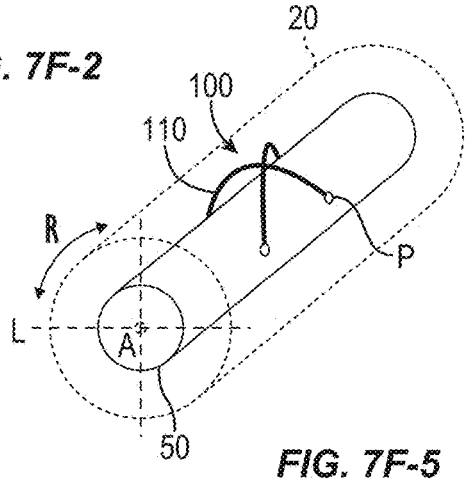

FIGS. 7F-1 through 7F-5 illustrate schematic end views of different elastic conductors for grounding assemblies 100 according to the present disclosure. In FIGS. 7F-1 through 7F-5, the elastic conductor is a spring 110, such as a coil spring, having ends affixed at points P to the charge holder 50. An intermediate portion or length of the spring 110 is biased away from the charge holder 50 to engage the inside surface of the carrier's passage 25.

In FIGS. 7F-1, the spring 110 is stretched along the longitudinal axis A of the charge holder 50 and has ends affixed at points P to the charge holder 50. An intermediate length of the spring 110 extends perpendicular to the circumference of the charge holder 50 to engage inside the carrier 20. In this and the other arrangements discussed below, the grounding contact from the spring 110 can be maintained between the charge holder 50 and the carrier 20 without causing increased friction in a rotational direction R between the carrier 20 and the charge holder 50 when turned or rotated relative to one another about the longitudinal axis A.

In FIG. 7F-2, two or more springs 110, such as coil springs, have ends affixed at points P on sides of the charge holder 50, and intermediate lengths of the coil springs 110 run along a longitudinal axis A of the charge holder 50. The intermediate lengths of the spring 110 can extend radially outward from a circumference of the charge holder 50. The springs 110 can engage the inside surface of the carrier's passage 25 and are elastic (e.g., flexible) in a rotational direction R without causing increased friction between the carrier 20 and the charge holder 50 when turned or rotated relative to one another about the longitudinal axis A.

In the previous arrangements, the grounding assembly 100 for grounding between the charge holder 50 and the carrier 20 has been described as using a spring 110 attached at points to the charge holder 50 and extending to engage the carrier 20. An opposite arrangement can be used for any of the various grounding assemblies 100 disclosed herein such that one or more elastic conductors, such as a spring, are attached to the carrier's passage 25 and extend to engage the charge holder 50.

In a brief example, FIG. 7F-3 shows a spring 110, such as coil springs, stretched in a lateral direction L and having ends affixed at points P to the inside surface of the carrier's passage 25. The intermediate length of the spring 110 extends to engage the charge holder 50. In an alternative arrangement, the spring 110 can be stretched along the longitudinal axis A of the charge holder 50 and can have ends affixed at points P to the inside surface of the carrier's passage 25 so the intermediate length of the spring 110 can extend to engage the charge holder 50.

In FIG. 7F-4, two springs 110, such as coil springs, are stretched along the longitudinal axis A of the charge holder 50 and have ends affixed at points P on opposing sides of the charge holder 50. As an alternative, ends of the two springs 110 can affixed at points P on a same side of the charge holder 50. Intermediate lengths of the springs 110 extend tangentially in opposing directions relative to the charge holder 50 to engage inside the carrier 20.

In FIG. 7F-5, two springs 110, such as coil springs, are stretched laterally (e.g., cross-wise, diagonally, or the like) relative to the longitudinal axis A of the charge holder 50. (The amount of lateral, cross-wise, or diagonal orientation of the springs 110 can range from as great as being orthogonal relative to the longitudinal axis A to as small as being non-longitudinal relative to the longitudinal axis A (i.e., not parallel to or not disposed along the longitudinal axis A.) Each spring 110 has ends affixed at points P on opposing sides of the charge holder 50. Intermediate lengths of the springs 110 extend toward the carrier 20 and run diagonally across the longitudinal axis A of the charge holder 50. The intermediate lengths of the springs 110 can run diagonally in the same direction, or they can run diagonally in opposing directions from one another. Additionally, as shown here, the springs 110 can crisscross each other.

As the arrangements in FIGS. 7C, 7D-1 through 7D-5, 7E, and 7F-1 through 7F-5 show, the grounding assembly 100 can use various form of elastic conductors 102, such as a spring, a coil spring, a bow spring, a leaf spring, a serpentine spring, a brush, a bristle, a wire, and the like. The grounding assembly 100 can use one or more of the elastic conductors 102, and multiple elastic conductor 102 can be arranged in different orientations (orthogonal, tangential, diagonal, cross-wise, lateral, etc.) relative to the longitudinal axis A so intermediate portions or lengths of the elastic conductors 102 can extend to engage inside the carrier 20 and complete electrical contact between the charge holder 50 and the carrier 20 at different rotational or angular orientations of the charge holder 50 inside the carrier 20.

Figure 8A:
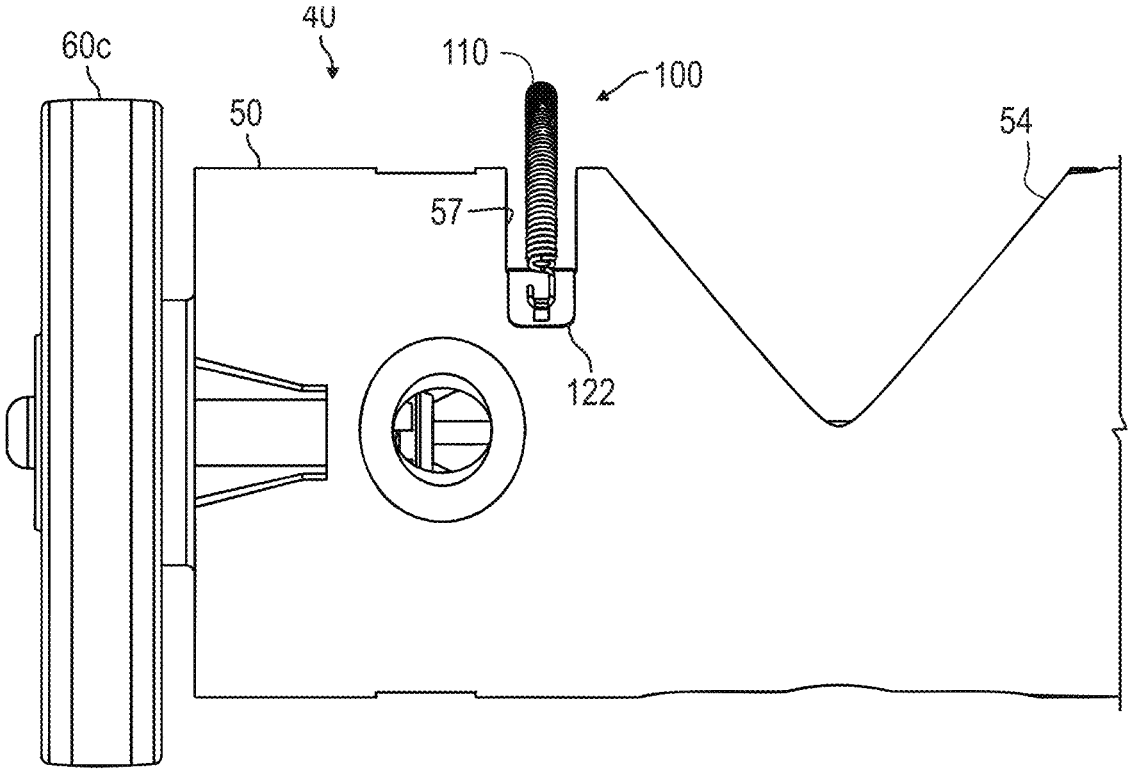
FIGS. 8A and 8B respectively illustrate a side view and a top view of the grounding assembly in FIG. 7A disposed on a charge holder.
Figure 8B:
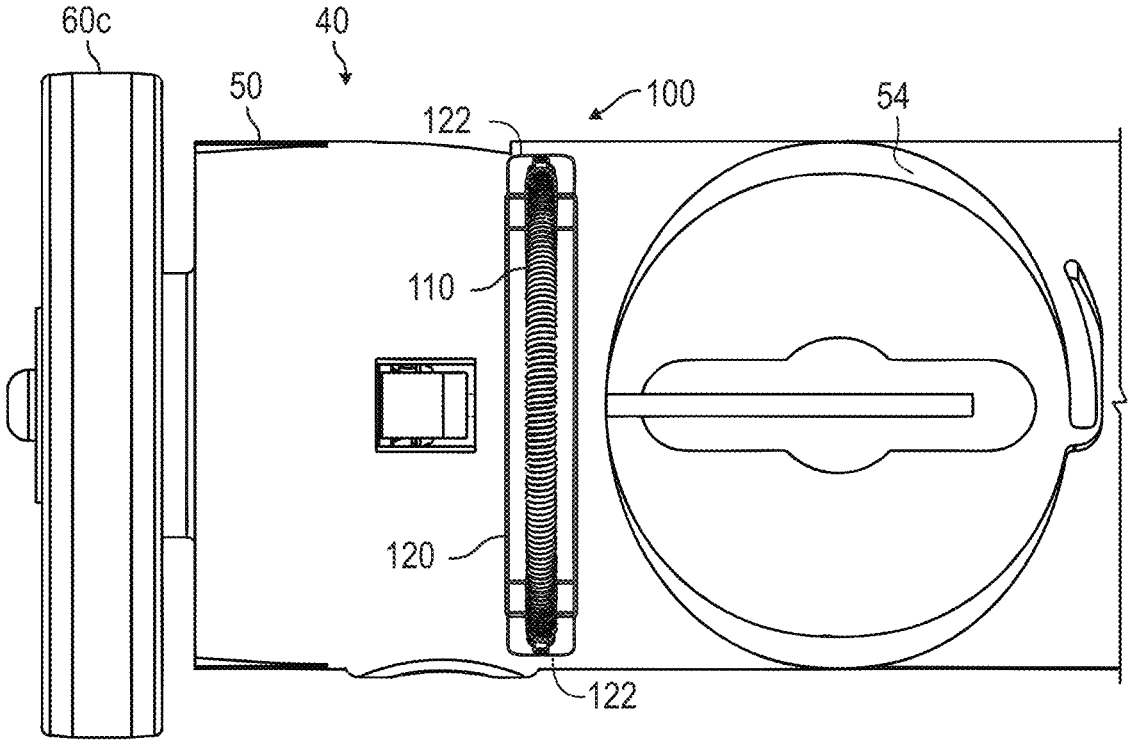

FIGS. 8A and 8B respectively illustrate a side view and a top view of the grounding assembly 100 in FIG. 7A disposed on a charge holder 50. The bow spring 120 fits within a cutaway or slot 57 in the charge holder 50, and the clips 122 on the ends of the bow spring 120 engage against lateral edges of the slot 57. This cutaway or slot 57 can be a dedicated slot as shown here, or an existing slot on the charge holder 50 can be used, such as the slot used for accessing any internal switch or weight arrangements of a charge assembly. The coil spring 110 is biased away from the bow spring 120 and the charge holder 50. As shown here, the charge holder 50 includes an uphole end fitting 60C configured with a bearing assembly for the charge holder 50 to rotate relative to the carrier (20) in which the charge holder 50 positions. The intermediate length of the coil spring 110 extends at least to the outer circumferential dimension of the uphole end fitting 60C, which would correspond to the inner diameter of the carrier's passage.

Figure 9A:
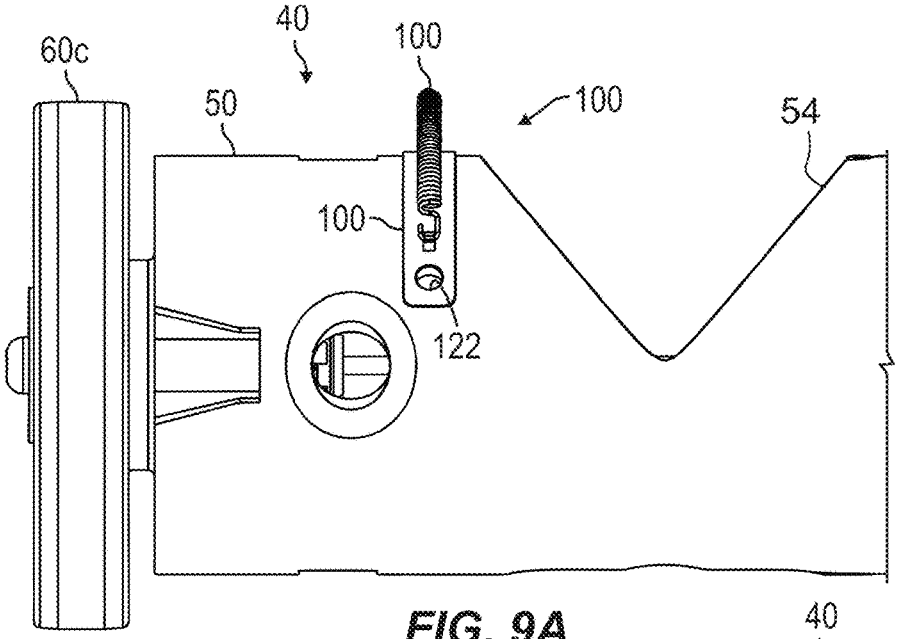
FIGS. 9A, 9B, and 9C respectively illustrate a side view, an opposite side view, and a top view of the grounding assembly in FIG. 7B disposed on a charge holder.
Figure 9B:
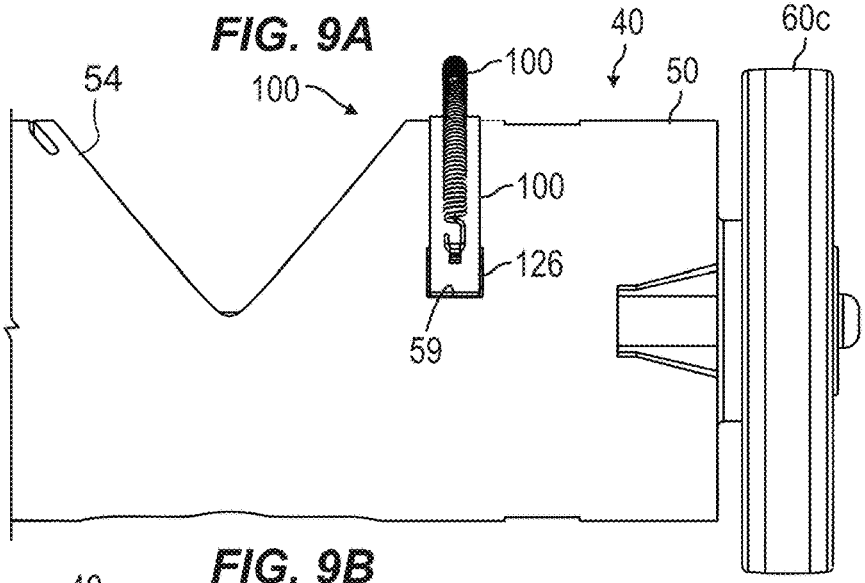
Figure 9C:
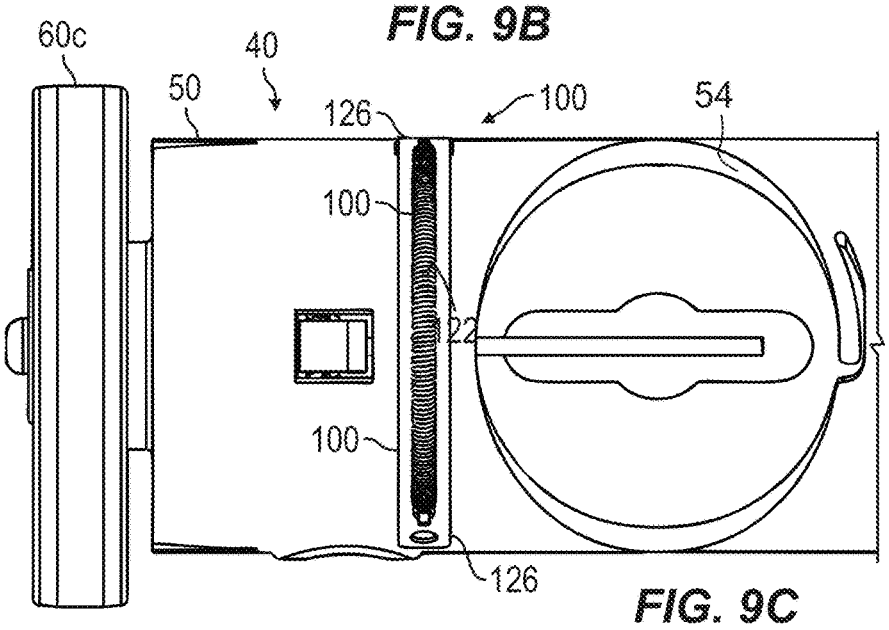

FIGS. 9A, 9B, and 9C respectively illustrate a side view, an opposite side view, and a top view of the grounding assembly 100 in FIG. 7B disposed on a charge holder 50. As best shown in FIG. 9B, the L-shaped clip 126 on the end of the bow spring 120 fits within a cutaway or slot 59 in the charge holder 50. The hole 124 on the other ends of the bow spring 120 can affix to the charge holder 50 using a fastener (not shown), such as a rivet, a screw, a tab, etc. The coil spring 110 is biased away from the bow spring 120 and the charge holder 50. As before, the intermediate length of the coil spring 110 extends at least to the outer circumferential dimension of the uphole end fitting 60C, which would correspond to the inner diameter of the carrier's passage.

Figure 10A:
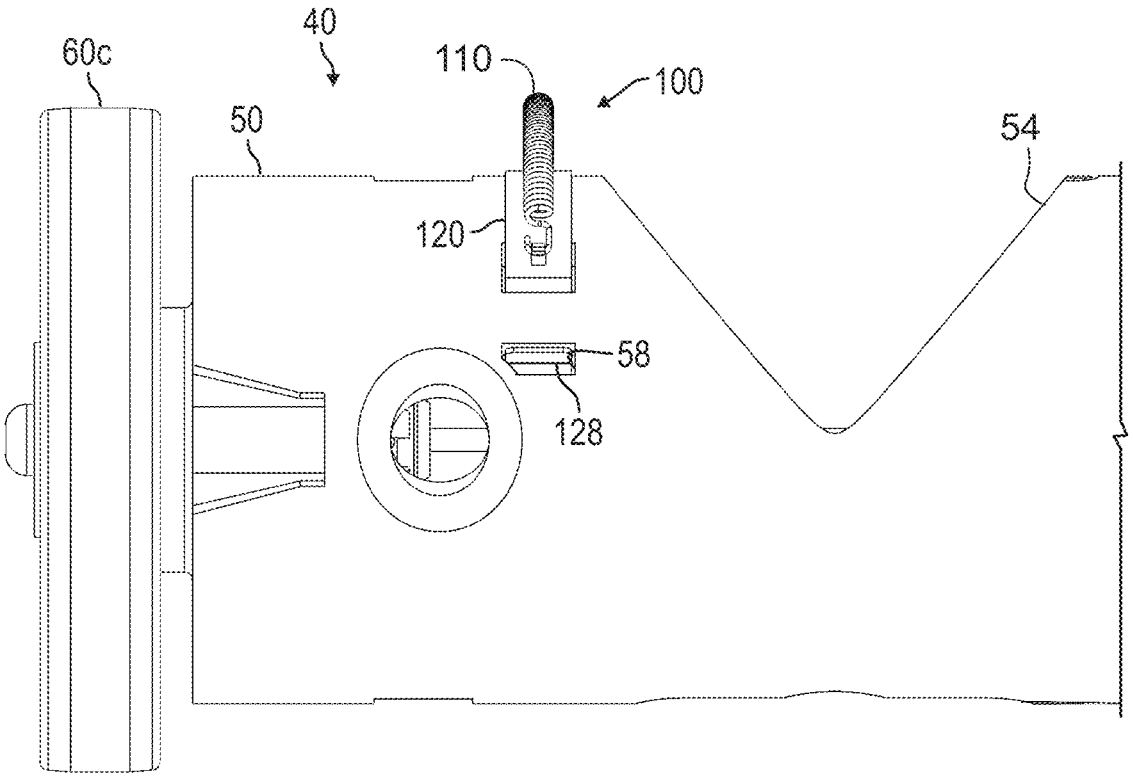
FIGS. 10A and 10B respectively illustrate a side view and a top view of a fourth grounding assembly disposed on a charge holder.
Figure 10B:
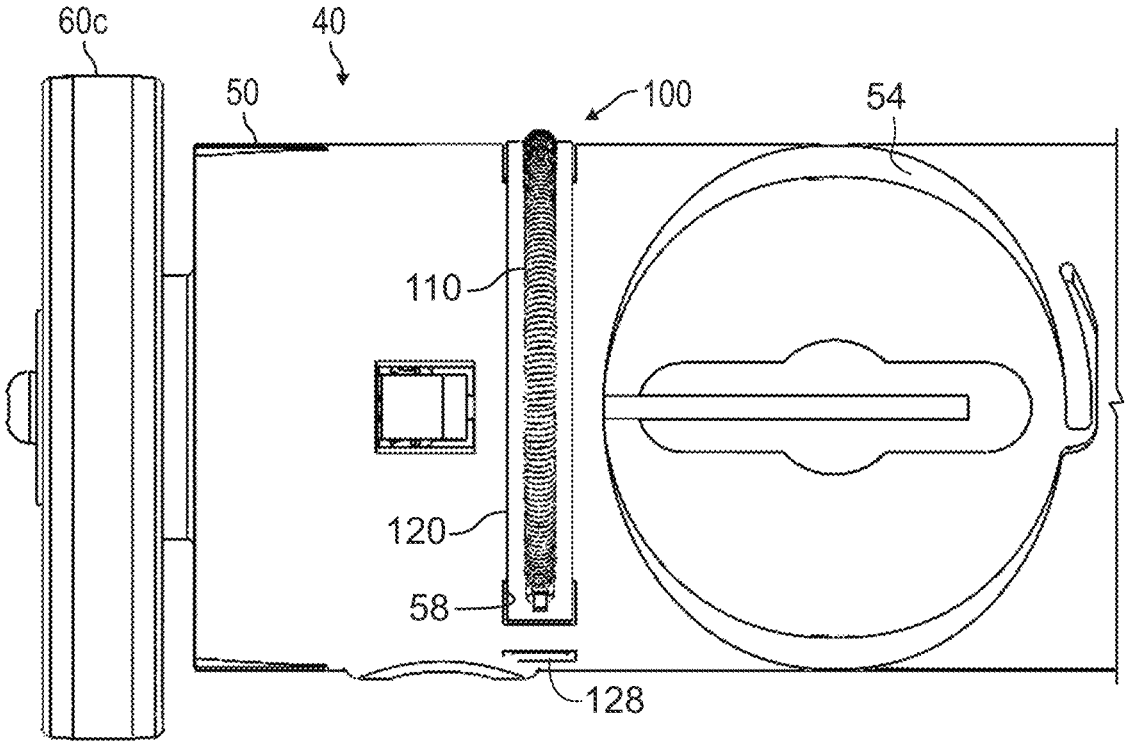

FIGS. 10A and 10B respectively illustrate a side view and a top view of another example of a grounding assembly 100 in disposed on a charge holder 50. This grounding assembly 100 also includes a coil spring 110 and a bow spring 120—both of which are composed of conductive material, such as a suitable metal. The coil spring 110 has ends connected toward ends of the bow spring 120. For example, hooking arrangements are shown, but other forms of connection can be used, including fasteners, welds, etc. U-shaped clips 128 are formed on ends of the bow spring 120 and fit within slotted openings 58 defined at points on the charge holder 50. As before, an intermediate length of the coil spring 110 is biased away from the bow spring 120 and the charge holder 50 and extends at least to the outer circumferential dimension of the uphole end fitting 60C, which would correspond to the inner diameter of the carrier's passage.

Figure 11A:
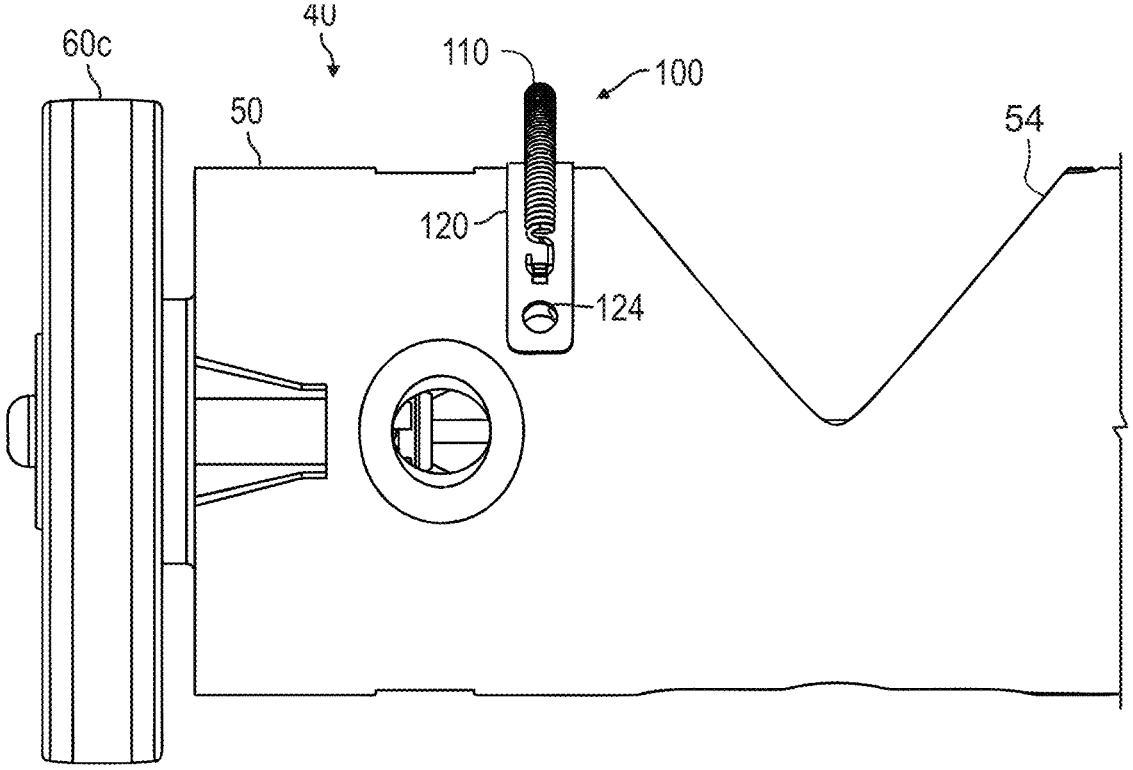
FIGS. 11A and 11B respectively illustrate a side view and a top view of a fifth grounding assembly disposed on a charge holder.
Figure 11B:
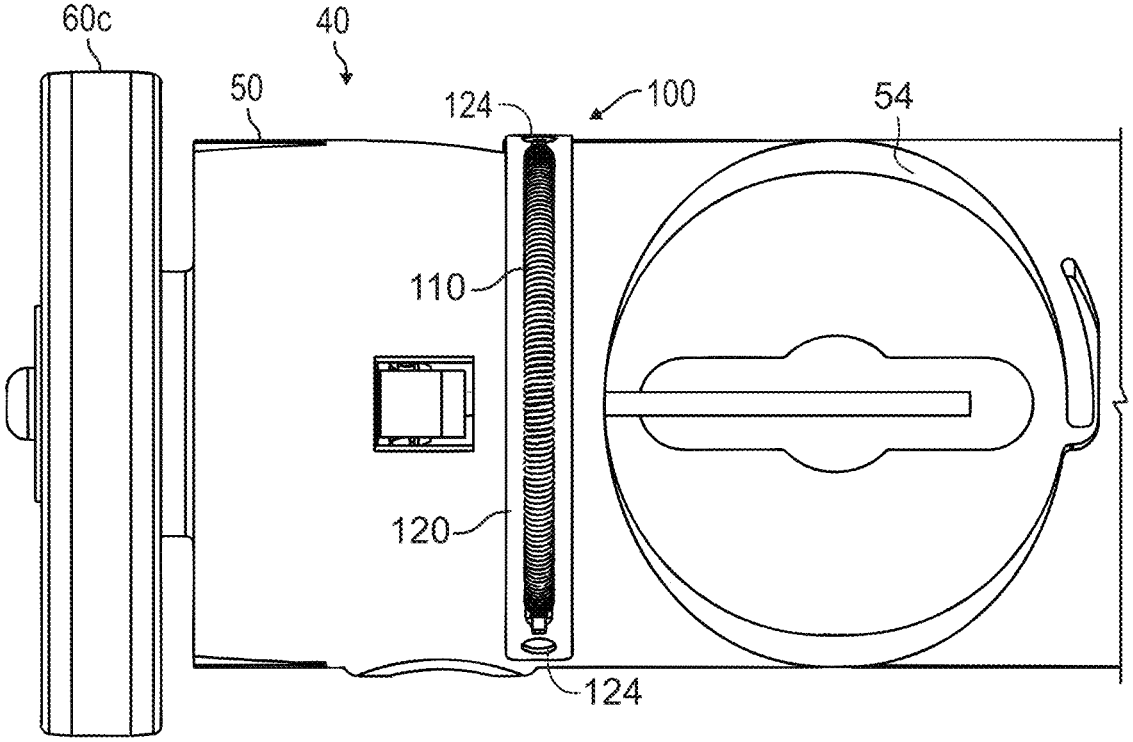

FIGS. 11A and 11B respectively illustrate a side view and a top view of yet another example of a grounding assembly 100 in disposed on a charge holder 50. This grounding assembly 100 also includes a coil spring 110 and a bow spring 120—both of which are composed of conductive material, such as a suitable metal. The coil spring 110 has ends connected toward ends of the bow spring 120. For example, hooking arrangements are shown, but other forms of connection can be used, including fasteners, welds, etc. Holes 124 are formed on both ends of the bow spring 120 and affix to the charge holder 50 using fasteners (not shown), such as rivets, screws, tab, etc., at points on the charge holder 50. As before, an intermediate length of the coil spring 110 is biased away from the bow spring 120 and the charge holder 50 and extends at least to the outer circumferential dimension of the uphole end fitting 60C, which would correspond to the inner diameter of the carrier's passage.

Figure 12A:
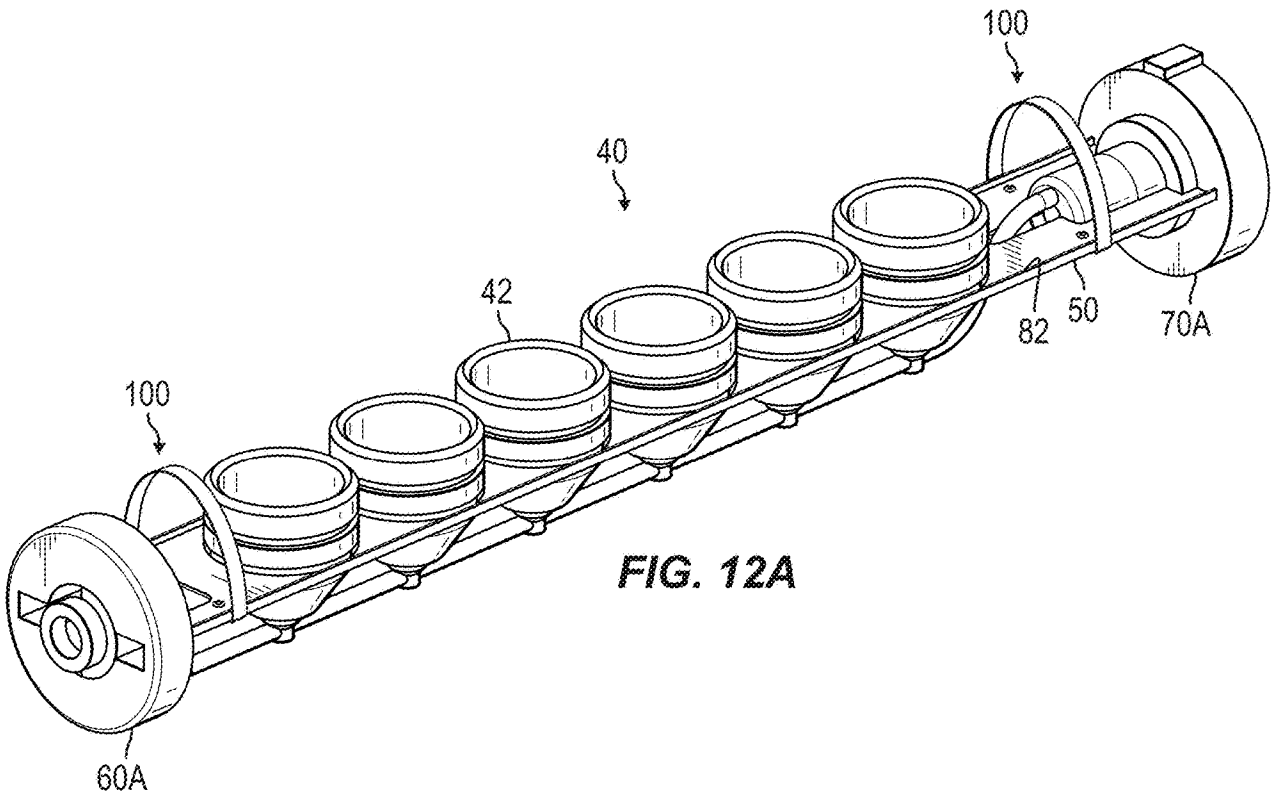
FIG. 12A illustrates a perspective view of an example of a charge assembly having a grounding assembly.
Figure 12B:
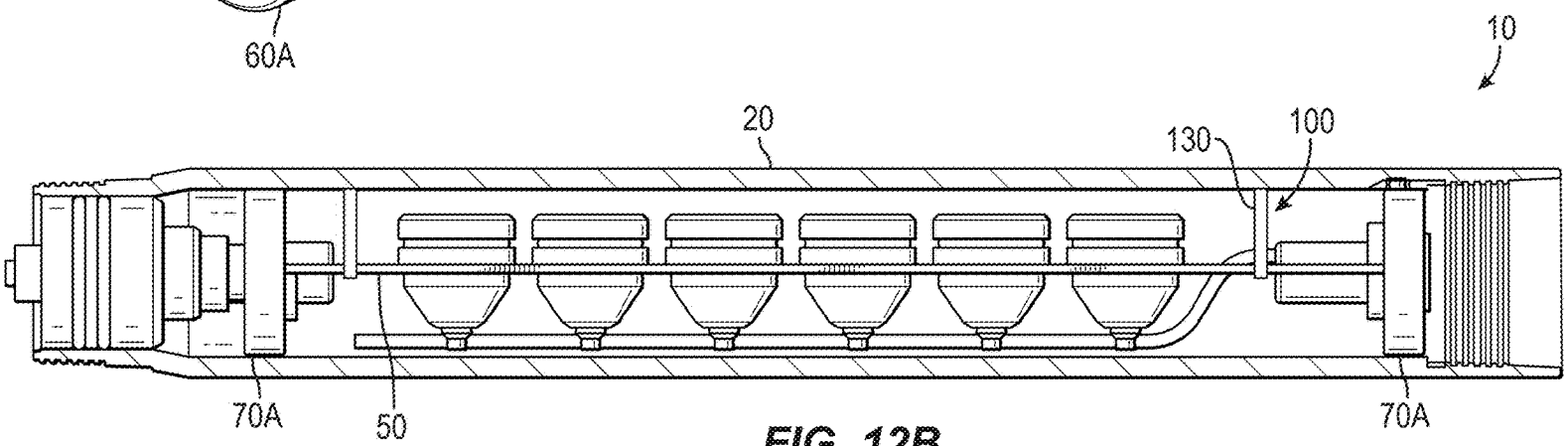
FIG. 12B illustrates a cross-sectional view of a perforating gun having the charge assembly and the grounding assembly of FIG. 12A.

In previous arrangements, the charge assembly 40 included a charge holder 50 that is a cylinder or tube. Other arrangements can benefit from the grounding assembly 100 of the present disclosure. For example, FIG. 12A illustrates a perspective view of a charge assembly 40 having a grounding assembly 100, and FIG. 12B illustrates a cross-sectional view of a perforating gun 10 having the charge assembly 40 and the ground assembly of FIG. 12A. Further details related to this perforating gun 10 can be found in U.S. application Ser. No. 18/317,485 filed May 15, 2023, which is incorporated herein by reference in its entirety.

The charge holder 40 may have any suitable shape, form, construction, and configuration. As shown here, the charge holder 50 may take the form of, or may include, one or more plates (i.e., a charge plate) configured to carry the explosive charges 42 in a desired orientation.

The charge holder 50 can be formed of a suitable material, such as a metallic material, a thermoplastic material, bendable metal, nylon, and the like. The charge holder 50 may be pre-formed at a desired length, or custom cut-to-size as needed, such as from a large roll or sheet of plate material (e.g., similar to the uses of extruded aluminum and Unistrut material in other industries). Likewise, the charge holder 50 may be pre-formed with charge holes, or custom-perforated as-needed to provide the desired number and location of charge holes.

The charge holder 50 can have a rectangular, tray-like shape and can include an inwardly facing lip extending down each side edge to provide rigidity. The charge holder 50 may be flat to position the shape charges 42 in the same plane, or the charge holder 50 can be curved to position the shape charges 42 at different angles and/or orientations.

If desired, an inner body conductor 82, such as described herein, may be pre-applied to the pre-formed charge holder 50, or the roll or sheet of plate material, in advance to save on the time, labor and expense of wrapping wire (or other types of) inner body conductor 82 during assembly of the perforating gun 10, for any other reason or a combination thereof.

The charge holder 50 may be secured in the perforating gun 10 in any suitable manner. For example, the charge holder 50 may be releasably, mechanically engaged with and carried by the end fitting 60A, 70A similarly as described above. For instance, the charge holder 50 can include one or more fingers that engage respective aligned receiving slots in the associated end fitting 60A, 70A. The fingers can be twist-locked to the end fittings 60A, 70B, or they can be engaged with an interference fit. However, the charge holder 50 could be supported in the perforating gun 10 in any other manner, and bolts, mateable features (e.g., one or more detents in end fitting 60A, 70B and one or more slots in the charge holder 50, etc.) can be used to connect the charge holder 50 to the end fittings 60A, 70A.

To improve the grounding of the perforating gun 10, one or more grounding assemblies 100 ground between the charge holder 50 and the carrier 20. As shown here, the grounding assemblies 100 include bow springs 130 attached to the edges of the charge holder 50. The bow springs 130 extend to laterally engage inside the carrier 20 in which the charge assembly 40 is inserted. Any of the other grounding assemblies 100 disclosed herein can be used.

The perforating gun 10 benefits by the additional grounding paths provided by the grounding assembly 100 connected between the carrier 20 and the charge holder 50. Additionally, the laterally arranged bow springs 130 can flex and adjust for internal contact inside the carrier 20 during assembly of the perforating gun 10 when the charge assembly 40 is inserted into the carrier's passage 25. Furthermore, the bow springs 130 engaged laterally relative to the longitudinal passage 25 can contact inside the carrier's passage 25 with less friction and resistance when the charge holder 50 is rotationally oriented about the longitudinal axis inside the carrier 20.

Ends of the bow spring 130 can be affixed to the charge holder 50 using any of the features discussed herein, such as fasteners, clips, and the like. If the charge holder 50 is composed of a conductive material, then the bow spring 130 can make direct grounding contact with the charge holder 50 to achieve the grounding discussed herein. If the charge holder 50 is composed of a non-conductive material, then a ground connection, such as a wire, trace, or the like can connect to one or both ends of the bow spring 130 to achieve the grounding. Again, other than the bow spring 130, the charge holder 50 can use any of the other forms of grounding assembly 100 disclosed herein, including a coil spring, a combination of coil and bow spring, etc.

Figure 13A:
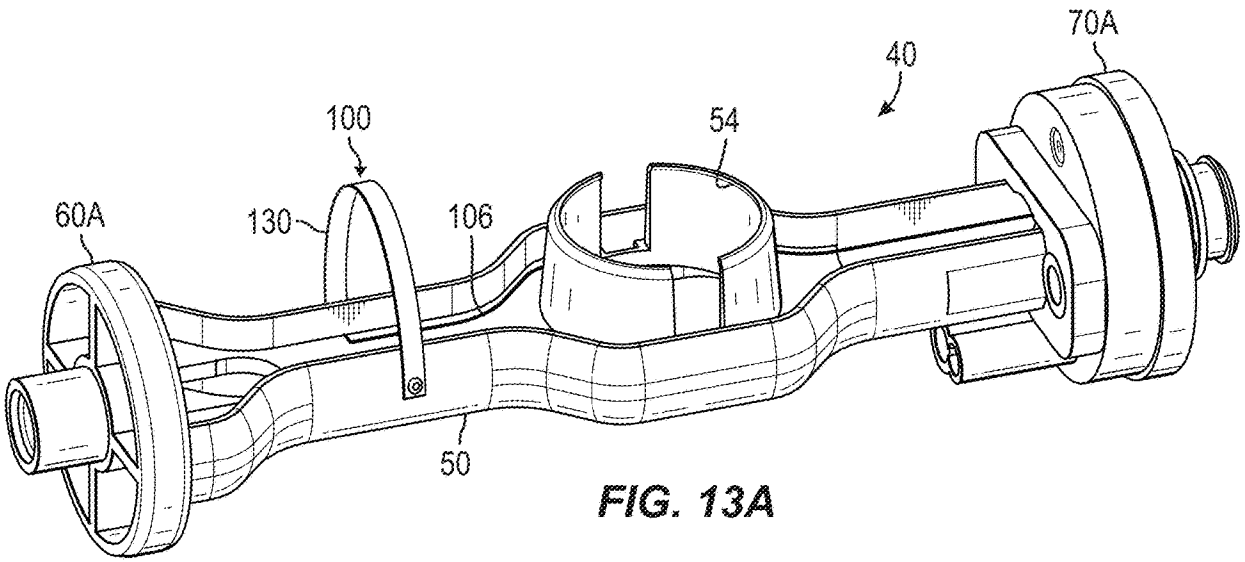
FIG. 13A illustrates a perspective view of another example of a charge assembly having a grounding assembly.
Figure 13B:
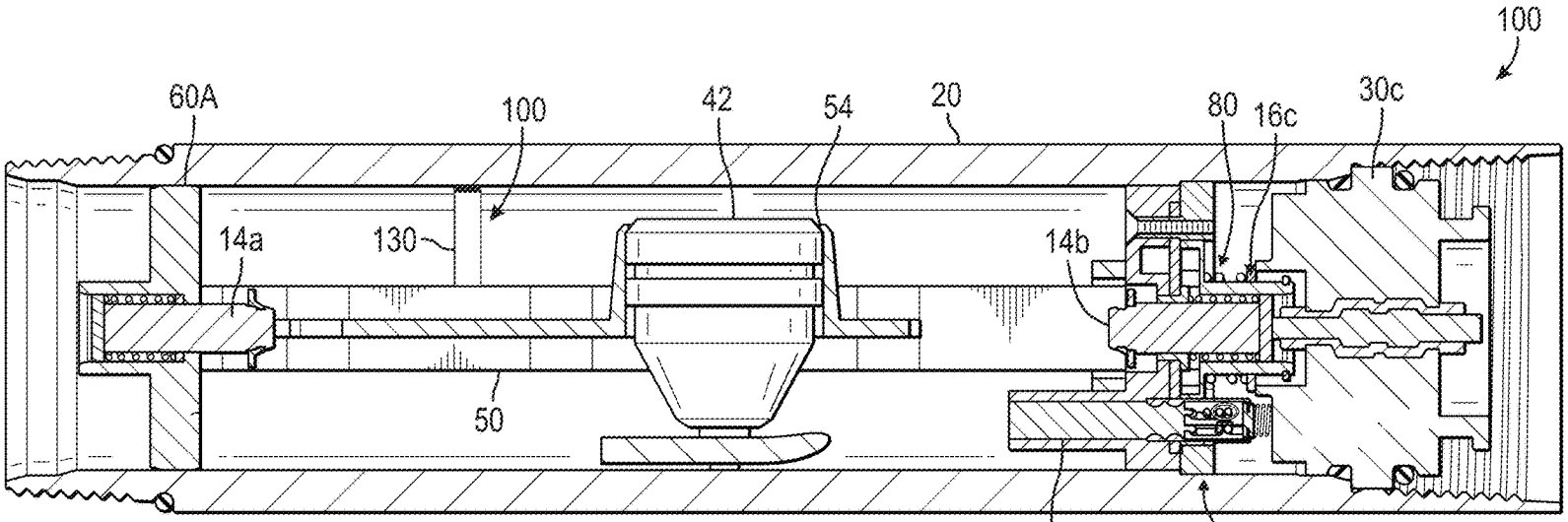
FIG. 13B illustrates a cross-sectional view of a perforating gun having the charge assembly and the grounding assembly of FIG. 13A.

FIG. 13A illustrates a perspective view of yet another example of charge assembly 40 having a grounding assembly 100, and FIG. 13B illustrates a cross-sectional view of a perforating gun 10 having the charge assembly 40 and the ground assembly 100 of FIG. 13A. Further details related to this perforating gun can be found in U.S. application Ser. No. 18/317,485 filed May 15, 2023, which is incorporated herein by reference in its entirety.

The charge holder 50 of this charge assembly 40 has an integrated end fitting 60A on one end. The other end of the charge holder 50 affixes to another end fitting 70A. As shown, the charge holder 40 has a charge receptacle 54 to house a shaped charge 42. The carrier 20 may have tapered pin and box thread respectively at the downhole end and the uphole end so carriers 20 of adjacent guns 10 can be connected end-to-end.

A wireless switch 80 and detonator 90 may be located in the perforating gun 10. As shown, for example, the switch 80 is positioned on the uphole side of a subcomponent or bulkhead 30*c*, and the switch 80 is coupled to the downhole end fitting 70A, which is disposed between the bulkhead 30*c* and the switch 80.

The downhole end fitting 70A and the switch 80 can be configured to hold the detonator 90. This configuration of the switch 80 and detonator 90 can use a wireless connection (i.e., a non-wired conductive interface) between them. In one example, a first wireless conductive contact of the switch 80 is in electrical communication with the electrical conductor 14*b*, and a second wireless conductive contact of the switch 80 is in electrical communication with a body conductor (not shown), which connects to the electrical conductor 14*a* on the first end of the charge assembly 40. A third wireless conductive contact of the switch 80 can be selectively coupled in electrical communication to the first wireless conductive contact; and the detonator 90 is in electrical communication with the third wireless conductive contact of the switch 80.

As before, the end fittings 60A, 70A have electrical conductors 14*a-b* for the electrical signal. Grounding for the ground signal is achieved via the carrier 20, bulkheads 30*c*, and ground conductors 16*c*. Wires, traces, and other ground connections 106 can be used.

To improve the grounding of the perforating gun 10, one or more grounding assemblies 100 ground between the charge holder 50 and the carrier 20. As shown here, the grounding assembly 100 includes a bow spring 130 attached to the edges of the charge holder 50. The bow spring 130 extends to laterally engage inside the carrier 20 in which the charge assembly 40 is inserted. Any of the other grounding assemblies 100 disclosed herein can be used.

The perforating gun 10 benefits by the additional grounding path provided by the grounding assembly 100 connected between the carrier 20 and charge holder 50. Additionally, the laterally arranged bow spring 130 can flex and adjust for internal contact inside the carrier 20 during assembly of the perforating gun 10 when the charge assembly 40 is inserted into the carrier's passage 25. Furthermore, the bow spring 130 engaged laterally relative to the longitudinal passage 25 can contact inside the carrier's passage 25 with less friction and resistance when the charge holder 50 is rotationally oriented about the longitudinal axis inside the carrier 20.

Ends of the bow spring 130 can be affixed to the charge holder 50 using any of the features discussed herein, such as fasteners, clips, and the like. If the charge holder 50 is composed of a conductive material, then the bow spring 130 can make direct grounding contact with the charge holder 50 to achieve the grounding discussed herein. If the charge holder 50 is composed of a non-conductive material, then a ground connection 106, such as a wire, a conductive trace, or the like can connect to one or both ends of the bow spring 130 to achieve the grounding. Again, other than the bow spring 130, the charge holder 50 can use any of the other forms of grounding assembly 100 disclosed herein, including a coil spring, a combination of coil and bow spring, etc.

Figure 14A:
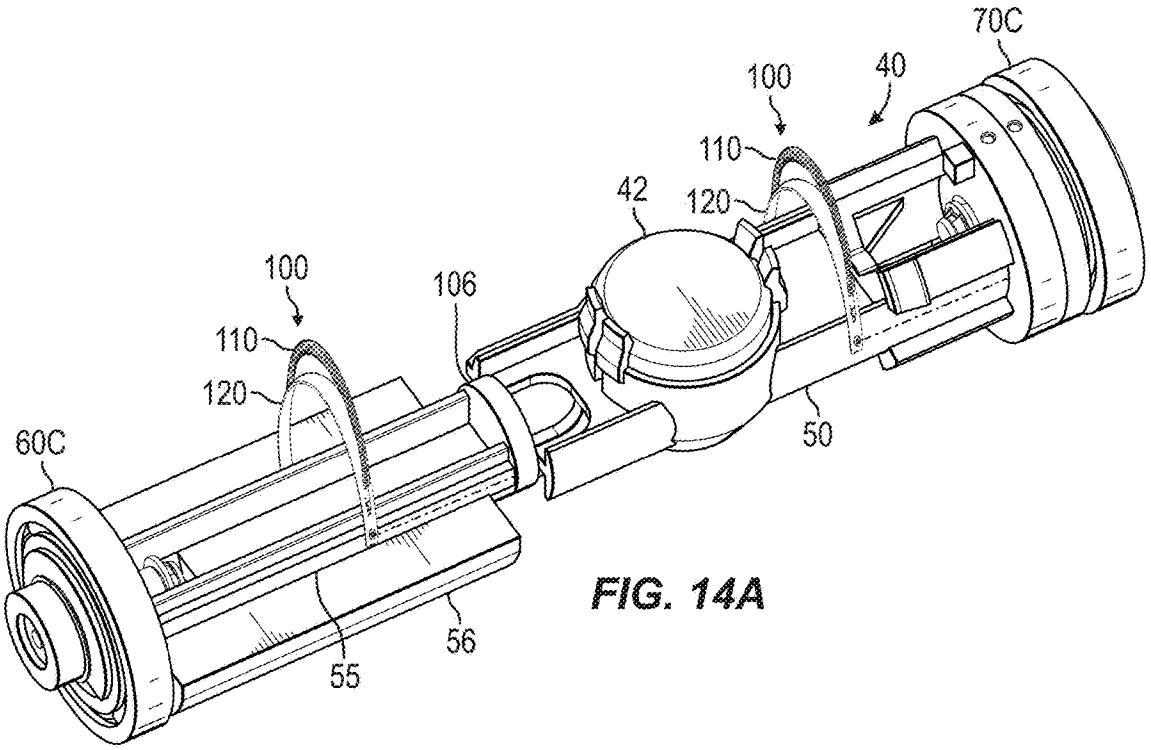
FIG. 14A illustrates a perspective view of a yet another example of a charge assembly having a grounding assembly.
Figure 14B:
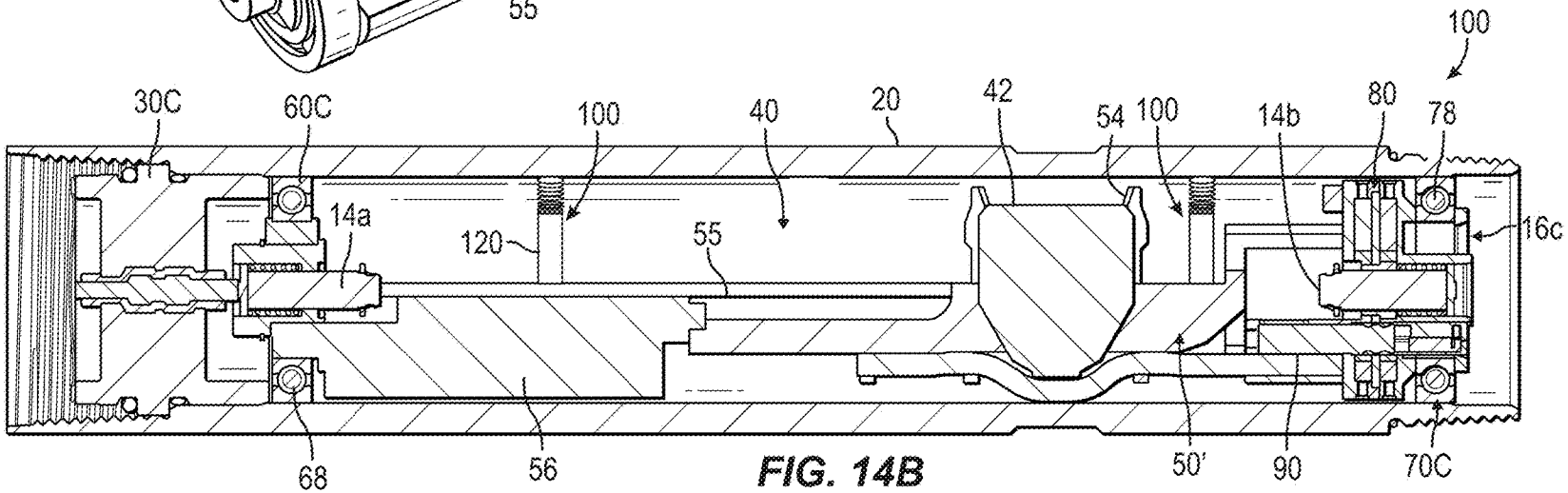
FIG. 14B illustrates a cross-sectional view of a perforating gun having the charge assembly and the grounding assembly of FIG. 14A.

FIG. 14A illustrates a perspective view of yet another example charge assembly 40 having a grounding assembly 100, and FIG. 14B illustrates a cross-sectional view of a perforating gun 10 having the charge assembly 40 and the grounding assembly 100 of FIG. 14A. Further details related to this perforating gun 10 can be found in U.S. application Ser. No. 18/317,485 filed May 15, 2023, which is incorporated herein by reference in its entirety.

The charge holder 50 has a longitudinal axis and has a weight 56 that is offset from the longitudinal axis of the charge holder 50. The end fittings 60C, 70C have bearing assemblies 68, 78 disposed concentrically about the longitudinal axis of the charge holder 50 and support the longitudinal axis of the charge holder 50 aligned along a longitudinal center axis of the carrier 20. The bearing assemblies 68, 78 permit the charge holder 50 to rotate relative to the carrier 20 so the rotational orientation of the charge holder 50 is based on gravity acting on the weight 56. The bearing assemblies 68, 78 can use radial bearings or thrust bearings.

As before, the end fittings 60C, 70C have electrical conductors 14*a-b* for the electrical signal. Grounding for the ground signal is achieved via the carrier 20, bulkheads 30*c*, and ground conductors 16*c*. Wires, traces, and other ground connections 106 can be used. Grounding may also be achieved via the bearing assemblies 68, 78, which can have metallic components. However, grounding via the bearing assemblies 68, 78 may not be solely relied upon.

To improve the grounding of the perforating gun 10, one or more grounding assemblies 100 ground between the carrier 20 and a ground signal. As shown here, the grounding assemblies 100 include coil springs 110 supported on bow springs 120, which have ends attached to the edges of the charge holder 50. The coil springs 110 extend to laterally engage inside the carrier 20 in which the charge assembly 40 is inserted. Any of the other grounding assemblies 100 disclosed herein can be used.

The perforating gun 10 benefits by the additional grounding paths provided by the grounding assemblies 100 connected between the carrier 20 and the charge holder 50. Additionally, the laterally arranged coil springs 110 can flex and adjust for internal contact inside the carrier 20 during assembly of the perforating gun 10 when the charge assembly 40 is inserted into the carrier's passage 25. Furthermore, the coil springs 110 engaged laterally relative to the longitudinal passage 25 can contact inside the carrier's passage 25 with less friction and resistance when the charge holder 50 is rotationally oriented about the longitudinal axis inside the carrier 20.

Ends of the bow spring 120 can be affixed to the charge holder 50 using any of the features discussed herein, such as fasteners, clips, and the like. If the charge holder 50 is composed of a conductive material, then the coil and bow springs 110, 120 can make direct grounding contact with the charge holder 50 to achieve the grounding discussed herein. If the charge holder 50 is composed of a non-conductive material, then a ground connection 106, such as a wire, a trace, or the like, can connect to one or both ends of the bow springs 120 to achieve the grounding. Again, other than the coil and bow springs 110. 120, the charge holder 50 can use any of the other forms of grounding assembly 100 disclosed herein.

The perforating gun 10 disclosed herein may be configured to orient around a central axis in a modular configuration. The perforating gun 10 may include all of the features of the embodiments described above and shown in the corresponding figures, except as described differently below or as may be evident from the appended figures or otherwise to persons skilled in the field of downhole perforating guns. With that caveat, all of the detailed description above and referenced figures are incorporated herein.

The charge holder 50 of the perforating gun 10 can have a charge module 50' and a weight module 55, which connect together in a modular fashion. For example, the two modules 50', 55 may connect together in two orthogonal orientations at an intermediate connection 51. The charge module 50' houses a charge receptacle 54 configured to retain a shaped charge 42. The weight module 55 houses a weight 56 configured to orient the perforating gun 10 around bearing assemblies 68, 78. A wireless switch 80 and detonator 90 may be located in the perforating gun 10. Electrical and grounding can be achieved using interfaces (wired or non-wired) at the intermediate connection 51.

Figure 15A:
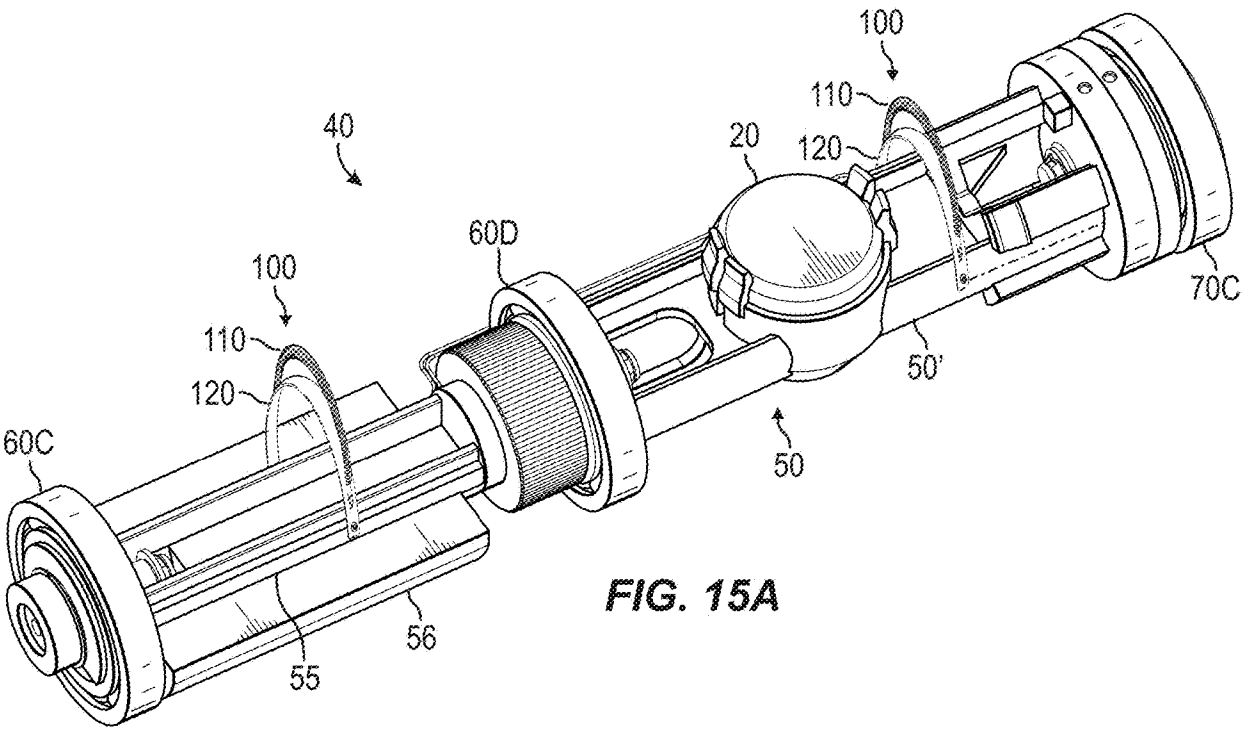
FIG. 15A illustrates a perspective view of a further example of a charge assembly having a grounding assembly.
Figure 15B:
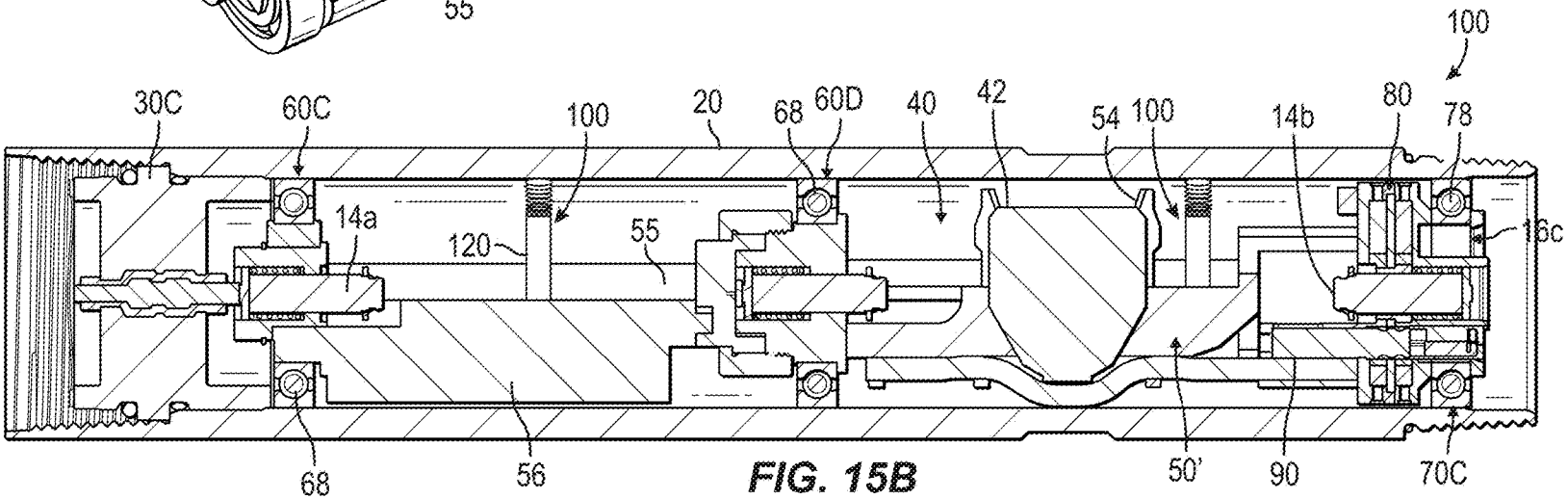
FIG. 15B illustrates a cross-sectional view of a perforating gun having the charge assembly and the grounding assembly of FIG. 15A.

FIG. 15A illustrates a perspective view of a further example of a charge assembly 40 having a grounding assembly 100, and FIG. 15B illustrates a cross-sectional view of a perforating gun 10 having the charge assembly 40 and the grounding assembly 100 of FIG. 15A. Further details related to this perforating gun 10 can be found in U.S. application Ser. No. 18/317,485 filed May 15, 2023, which is incorporated herein by reference in its entirety.

This charge assembly 40 is similar to that disclosed above, except that the weight 56 is disposed on a weight module 55, which can be adjusted relative to a charge module 50' of the charge holder 50 having the charge receptacle 54. Again, the charge holder 50 has a longitudinal axis. The weight 56 of the weight module 55 is offset from the longitudinal axis of the charge module 50'. The end fittings 60C, 70C have bearing assemblies 68, 78 disposed concentrically about the longitudinal axis of the charge holder 50 and support the longitudinal axis of the charge holder 50 aligned along a longitudinal center axis of the carrier 20. The bearing assemblies 68, 78 of the end fittings 60C, 70C permit the charge holder 50 to rotate relative to the carrier 20 so the rotational orientation of the charge holder 50 is based on gravity acting on the weight 56. The bearing assemblies 68, 78 can use radial bearings or thrust bearings.

As before, the end fittings 60C, 70C have electrical conductors 14*a-b* for the electrical signal. Grounding for the ground signal is achieved via the carrier 20, bulkheads 30*c*, and ground conductors 16*c*. Wires, traces, and other ground connections 106 can be used. Grounding may also be achieved via the bearing assemblies 68, 78, which can have metallic components. However, grounding via the bearing assemblies 68, 78 of the end fitting 60C, 70C may not be solely relied upon. Communication of the electrical signal and grounding signal can also be achieved via interfaces (wired or non-wired) on the intermediate connection 51.

To improve the grounding of the perforating gun 10, one or more grounding assemblies 100 ground between the charge holder 50 and the carrier 20. As shown here, the grounding assemblies 100 include coil springs 110 supported on bow springs 120, which have ends attached to the edges of the charge holder 50. The coil springs 110 extend to laterally engage inside the carrier 20 in which the charge assembly 40 is inserted. Any of the other grounding assemblies 100 disclosed herein can be used.

The perforating gun 10 benefits by the additional grounding paths provided by the grounding assemblies 100 connected between the carrier 20 and the charge holder 50. Additionally, the laterally arranged coil springs 110 can flex and adjust for internal contact inside the carrier 20 during assembly of the perforating gun 10 when the charge assembly 40 is inserted into the carrier's passage 25. Furthermore, the coil springs 110 engaged laterally relative to the longitudinal passage 25 can contact inside the carrier's passage 25 with less friction and resistance when the charge holder 50 is rotationally oriented about the longitudinal axis inside the carrier 20.

Ends of the bow spring 120 can be affixed to the charge holder 50 using any of the features discussed herein, such as fasteners, clips, and the like. If the charge holder 50 is composed of a conductive material, then the coil and bow springs 110, 120 can make direct grounding contact with the charge holder 50 to achieve the grounding discussed herein. If the charge holder 50 is composed of a non-conductive material, then one or more ground connections 106, such as a wire, a trace, or the like can connect to one or both ends of the bow springs 120 to achieve the grounding. Again, other than the coil and bow springs 110. 120, the charge holder 50 can use any of the other forms of grounding assembly 100 disclosed herein.

The perforating gun 10 may be configured to orient around the central axis.

A first portion of the charge holder 50 (i.e., the charge module 50') is coupled to a second portion of the charge holder 50 (i.e., the weight module 55) with the intermediate connection 51. An intermediate support 60D having a bearing assembly 68 can be disposed at the intermediate connection 51 between the weight module 55 and the remainder of the charge module 50'. The intermediate connection 51 is configured to adjust a radial position of the weight module 55 relative to the charge module 50' about the longitudinal axis. For example, the intermediate connection 51 can include mating collars to transfer torque from the weight module 55 to the charge module 50'. The collars can include complementary teeth so the weight module 55 can be set at a specific orientation relative to the charge module 50'.

The foregoing description of preferred and other embodiments is not intended to limit or restrict the scope or applicability of the inventive concepts conceived of by the Applicants. It will be appreciated with the benefit of the present disclosure that features described above in accordance with any embodiment or aspect of the disclosed subject matter can be utilized, either alone or in combination, with any other described feature, in any other embodiment or aspect of the disclosed subject matter.

In exchange for disclosing the inventive concepts contained herein, the Applicants desire all patent rights afforded by the appended claims. Therefore, it is intended that the appended claims include all modifications and alterations to the full extent that they come within the scope of the following claims or the equivalents thereof.

What is claimed is:

1. A perforating gun, comprising:

a carrier defining a longitudinal passage therethrough;

a holder having one or more charge receptacles, the holder having a longitudinal axis and being configured to position in the longitudinal passage;

a first electrical conductor configured to conduct an electrical signal for the perforating gun;

a ground conductor configured to conduct a ground signal for the perforating gun; and at least one elastic conductor extending between the holder and the longitudinal passage, the at least one elastic conductor being elastic at least in a rotational direction about the longitudinal axis of the holder in response to a change in a rotational orientation of the holder about the longitudinal axis relative to the carrier, the at least one elastic conductor disposed in electrical communication with the carrier and the ground signal.

2. The perforating gun of claim 1, wherein the at least one elastic conductor is selected from the group consisting of a spring, an extension spring, a compression spring, a coil spring, a bow spring, a leaf spring, a serpentine spring, a brush, a bristle, and a wire.

3. The perforating gun of claim 1, wherein the at least one elastic conductor comprises first and second element ends and comprises an intermediate length between the first and second element ends, and wherein:

the first and second element ends are attached respectively at first and second points to the holder, the intermediate length extending in a direction away from the holder toward the longitudinal passage; or the first and second element ends are attached respectively at first and second points to the longitudinal passage, the intermediate length extending in the direction away from the longitudinal passage toward the holder.

4. The perforating gun of claim 3, wherein the intermediate length of the at least one elastic conductor is disposed parallel to the longitudinal axis of the holder, is disposed along the longitudinal axis of the holder, is disposed perpendicular to the longitudinal axis of the holder, is disposed laterally relative to the longitudinal axis of the holder, is disposed diagonally across the longitudinal axis of the holder, or is disposed non-longitudinal relative to the longitudinal axis of the holder.

5. The perforating gun of claim 1, wherein the at least one elastic conductor comprises a coil spring having first and second spring ends between an intermediate portion, the first and second spring ends being configured to attach to respective points on the holder, the intermediate portion being biased in a direction away from the holder toward the longitudinal passage.

6. The perforating gun of claim 5, wherein at least one of the first and second spring ends of the coil spring is affixed with a fastener to the holder.

7. The perforating gun of claim 1, wherein the at least one elastic conductor comprises:

a fixture having first and second fixture ends, the first and second fixture ends being configured to attach to respective points on the holder; and a coil spring having first and second spring ends between an intermediate portion, the first and second spring ends being attached respectively toward the first and second fixture ends, the intermediate portion being biased in a direction away from the holder toward the longitudinal passage.

8. The perforating gun of claim 7, wherein the fixture comprises a bow spring; and wherein at least one of the first and second fixture ends of the bow spring is affixed with a fastener to the holder and/or with a clip engaged against an edge defined in the holder.

9. The perforating gun of claim 1, wherein the holder is comprised of a conductive material configured to conduct the ground signal, the ground signal being conducted by a wire, a wireless contact, or a wireless trace between the ground conductor and the holder; or wherein the holder is comprised of a non-conductive material, the ground signal being conducted by a wire, a wire contact, or a wireless trace between the ground conductor and the at least one elastic conductor.

10. The perforating gun of claim 1, wherein the holder comprises a first end configured to support the holder in the longitudinal passage, the first end having the first electrical conductor for the electrical signal and having the ground conductor for the ground signal.

11. The perforating gun of claim 10, wherein the first electrical conductor is movable between an extended position and a retracted position on the first end of the holder, and the first electrical conductor comprises a spring biasing the first electrical conductor toward the extended position; and wherein the ground conductor is movable between an extended position and a retracted position on the first end of the holder, and the ground conductor comprises a spring biasing the ground conductor toward the extended position.

12. The perforating gun of claim 10, further comprising:

a second end of the holder being configured to support the holder in the longitudinal passage, the second end having a second electrical conductor for the electrical signal; and a body conductor disposed in the longitudinal passage and disposed in electrical communication with the second electrical conductor.

13. The perforating gun of claim 1, further comprising:

a switch being configured to position in the longitudinal passage and disposed in electrical communication with the electrical signal and the ground signal; and a detonator being configured to position in the longitudinal passage and disposed in electrical communication with the switch.

14. The perforating gun of claim 13, wherein the switch comprises a plurality of contacts, the contacts at least including:

a first telemetry contact for the electrical signal disposed in electrical communication with the first electrical conductor;

a second telemetry contact for the electrical signal disposed in electrical communication with a body conductor, the body conductor disposed in the longitudinal passage and disposed in electrical communication with a second electrical conductor;

a ground contact disposed in electrical communication with the ground signal;

a hot detonator contact disposed in electrical communication with the detonator; and a ground detonator contact disposed in electrical communication with the detonator.

15. The perforating gun of claim 14, wherein one or more of the contacts of the switch comprise a non-wired conductive interface.

16. The perforating gun of claim 1, wherein the holder comprises an end fitting configured to adjust the rotational orientation of the holder about the longitudinal axis in the longitudinal passage of the carrier;

wherein the end fitting comprises:

a first support disposed on an end of the holder and having a first mating surface; and a second support disposed adjacent to the first support and having a second mating surface, the second support being configured to fit in a set rotational orientation relative to the carrier and being configured to support the end of the holder in the longitudinal passage, the first and second mating surfaces having a mating feature configured to mate the first and second mating surfaces at different rotational orientations relative to one another; and wherein the at least one elastic conductor is elastic at least in the rotational direction about the longitudinal axis of the holder in response to the change in the rotational orientation between the holder relative to the carrier.

17. The perforating gun of claim 1, wherein the holder comprises a weight being offset from the longitudinal axis of the holder;

wherein the holder comprises a bearing assembly disposed concentrically about the longitudinal axis of the holder and supporting the longitudinal axis of the holder aligned along a longitudinal center axis of the carrier, the bearing assembly being configured to adjust the rotational orientation of the holder relative to the carrier based on gravity acting on the weight; and wherein the at least one elastic conductor is elastic at least in the rotational direction about the longitudinal axis of the holder in response to the change in the rotational orientation between the holder relative to the carrier.

18. A perforating gun, comprising:

a carrier defining a longitudinal passage therethrough;

a holder having one or more charge receptacles, the holder having a longitudinal axis and being configured to position in the longitudinal passage;

a first end of the holder comprising a first bearing assembly disposed concentrically about the longitudinal axis of the holder, the first bearing assembly supporting the longitudinal axis of the holder aligned along a longitudinal center axis of the carrier and being configured to adjust a rotational orientation of the holder about the longitudinal axis relative to the carrier, the first end having a first electrical conductor for an electrical signal and having a ground conductor for a ground signal; and at least one elastic conductor extending between the holder and the longitudinal passage, the at least one elastic conductor being elastic at least in a rotational direction about the longitudinal axis of the holder in response to a change in the rotational orientation between the holder relative to the carrier, the at least one elastic conductor disposed in electrical communication with the carrier and the ground signal.

19. The perforating gun of claim 18, wherein the holder comprises a weight being offset from the longitudinal axis of the holder; and wherein the first bearing assembly is configured to adjust the rotational orientation of the holder relative to the carrier based on gravity acting on the weight.

20. The perforating gun of claim 19, wherein a second end of the holder comprises a second bearing assembly being configured to support the holder in the longitudinal passage, the second end comprising a second electrical conductor for the electrical signal.

21. The perforating gun of claim 20, wherein the first and second ends of the holder are connected together at an intermediate connection, one of the first and second ends having the weight, the intermediate connection being configured to adjust a rotational position of the first end relative to the second end about the longitudinal axis of the holder.

22. A method of assembling a system of perforating guns, the method comprising not necessarily in sequence:

assembling an assembled perforating gun;

coupling a gun carrier at an end connection to the assembled perforating gun;

sealing off longitudinal passages between the gun carrier and the assembled perforating gun at the end connection;

providing a feedthrough conductor being configured to electrically conduct an electrical signal across the end connection;

placing a first electrical conductor on a charge assembly in electrical contact with the feedthrough conductor by positioning the charge assembly in the longitudinal passage of the gun carrier; and grounding between the gun carrier and a ground conductor on the charge assembly by elastically engaging at least one elastic conductor extending between the charge assembly and the longitudinal passage of the gun carrier, the at least one elastic conductor being elastic at least in a rotational direction about a longitudinal axis of the charge assembly in response to a change in a rotational orientation of the charge assembly about the longitudinal axis relative to the gun carrier.

23. The method of claim 22, wherein positioning the charge assembly in the longitudinal direction in the longitudinal passage of the gun carrier comprises:

supporting the charge assembly in the longitudinal passage of the gun carrier using first and second end fittings disposed on first and second ends of a charge holder;

setting the rotational orientation of the second end fitting relative to the charge holder;

placing the first end fitting in the longitudinal passage to support the first end of the charge holder; and engaging the second end fitting in a set position in the longitudinal passage to support the second end of the charge holder.

24. The method of claim 22, wherein positioning the charge assembly in the longitudinal passage of the gun carrier comprises:

supporting the charge assembly in the longitudinal passage of the gun carrier using first and second bearing assemblies disposed on first and second ends of the charge assembly; and permitting the charge assembly to rotate in the longitudinal passage about the first and second bearing assemblies.

25. The method of claim 22, wherein sealing off the longitudinal passages at the end connection and providing the feedthrough conductor comprises sealing off the longitudinal passage at the end connection using a bulkhead, the bulkhead having the feedthrough conductor that is configured to electrically conduct the electrical signal across the end connection.

* * * * *